US009651283B2

(12) United States Patent
Eguchi et al.

(10) Patent No.: US 9,651,283 B2
(45) Date of Patent: May 16, 2017

(54) REFRIGERANT CHANNEL SWITCHING UNIT

(71) Applicant: DAIKIN INDUSTRIES, LTD., Osaka-shi, Osaka (JP)

(72) Inventors: Akihiro Eguchi, Sakai (JP); Shigeki Kamitani, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 15/103,257

(22) PCT Filed: Dec. 3, 2014

(86) PCT No.: PCT/JP2014/082005

§ 371 (c)(1),
(2) Date: Jun. 9, 2016

(87) PCT Pub. No.: WO2015/087757

PCT Pub. Date: Jun. 18, 2015

(65) Prior Publication Data

US 2016/0377332 A1 Dec. 29, 2016

(30) Foreign Application Priority Data

Dec. 11, 2013 (JP) ..... 2013-256480

(51) Int. Cl.
*F25B 41/04* (2006.01)
*F25B 13/00* (2006.01)
*F25B 49/02* (2006.01)

(52) U.S. Cl.
CPC ..... *F25B 41/046* (2013.01); *F25B 13/00* (2013.01); *F25B 41/04* (2013.01); *F25B 49/02* (2013.01);

(Continued)

(58) Field of Classification Search
CPC ..... F25B 13/00; F25B 41/04; F25B 41/043; F25B 41/046; F25B 47/00–47/027;

(Continued)

(56) References Cited

FOREIGN PATENT DOCUMENTS

JP 3-61794 A 3/1991
JP 11173604 A * 7/1999

(Continued)

OTHER PUBLICATIONS

International Preliminary Report of corresponding PCT Application No. PCT/JP2014/082005 dated Jun. 23, 2016.

(Continued)

*Primary Examiner* — Orlando E Aviles Bosques
*Assistant Examiner* — Antonio R Febles
(74) *Attorney, Agent, or Firm* — Global IP Counselors, LLP

(57) ABSTRACT

A refrigerant channel switching unit is disposed between a heat source unit and a utilization unit to switch flow of refrigerant in the refrigerant circuit. The refrigerant channel switching unit includes a first refrigerant pipe connected to a suction gas communicating pipe extending from the heat source unit, a second refrigerant pipe connected to a high-low pressure gas communicating pipe extending from the heat source unit, a third refrigerant pipe connected to a gas pipe extending to the utilization unit, a coupling portion, a first switch valve mounted to the first refrigerant pipe, and a second switch valve mounted to the second refrigerant pipe. The coupling portion is connected to the first, second and third refrigerant pipes. The First second and third are coupled through the coupling portion.

5 Claims, 16 Drawing Sheets

(52) U.S. Cl.
CPC ... *F25B 2313/007* (2013.01); *F25B 2313/027* (2013.01); *F25B 2313/029* (2013.01); *F25B 2313/0231* (2013.01); *F25B 2313/0253* (2013.01); *F25B 2313/0292* (2013.01); *F25B 2400/13* (2013.01); *F25B 2500/01* (2013.01); *F25B 2600/25* (2013.01)

(58) Field of Classification Search
CPC ..... F25B 49/00; F25B 49/002; F25B 49/005; F16L 59/16–59/22; F24F 1/26
See application file for complete search history.

(56) References Cited

FOREIGN PATENT DOCUMENTS

| | | | | | |
|---|---|---|---|---|---|
| JP | EP 1876398 | A1 * | 1/2008 | ..... | F24F 1/26 |
| JP | 2008-39276 | A | 2/2008 | | |
| JP | 2010-286129 | A | 12/2010 | | |
| JP | EP 2402666 | A2 * | 1/2012 | ..... | F24F 1/26 |
| KR | GB 2451722 | A * | 2/2009 | ..... | F24F 1/26 |
| KR | EP 2365254 | A2 * | 9/2011 | ..... | F24F 1/26 |
| KR | EP 2450637 | A2 * | 5/2012 | ..... | F24D 17/02 |

OTHER PUBLICATIONS

International Search Report of corresponding PCT Application No. PCT/JP2014/082005 dated Mar. 10, 2015.

* cited by examiner

REFRIGERANT CHANNEL SWITCHING UNIT

CROSS-REFERENCE TO RELATED APPLICATIONS

This U.S. National stage application claims priority under 35 U.S.C. §119(a) to Japanese Patent Application No. 2013-256480, filed in Japan on Dec. 11, 2013, the entire contents of which are hereby incorporated herein by reference.

TECHNICAL HELD

The present invention relates to a refrigerant channel switching unit and an aggregated channel switching unit for switching flow of refrigerant.

BACKGROUND ART

There has been so far a refrigerant channel switching unit disposed between a heat source unit and a utilization unit of an air conditioning system and configured to switch flow of refrigerant. For example, an air conditioning system disclosed in Japan Laid-open Patent Application Publication No. 2008-39276 includes a plurality of refrigerant channel switching units installed between a heat source unit and a plurality of utilization units. Each of the refrigerant channel switching units is provided with a first refrigerant pipe, a second refrigerant pipe, a third refrigerant pipe and a coupling portion. The first refrigerant pipe is provided with a switch valve and is connected to a suction gas communicating pipe extending from the heat source unit. The second refrigerant pipe is provided with a switch valve and is connected to a high-low pressure gas communicating pipe extending from the heat source unit. The third refrigerant pipe is connected to a gas pipe extending to the utilization unit. The coupling portion couples these refrigerant pipes. In this type of refrigerant channel switching unit, it is required to bypass refrigerant from the second refrigerant pipe to the first refrigerant pipe in order to prevent the refrigerant from stagnating within the second refrigerant pipe when the utilization is in a thermo-off state, a deactivated state or the like.

SUMMARY

Technical Problem

FIG. 1 schematically illustrates the positional relation among the first refrigerant pipe, the second refrigerant pipe and the third refrigerant pipe in the conventional refrigerant channel switching unit. In a conventional refrigerant channel switching unit 1 shown in FIG. 1, a third refrigerant pipe RP3 is connected to a first refrigerant pipe RP1 and a second refrigerant pipe RP2 at a coupling portion 2 and downwardly extends from the coupling portion 2. However, in the conventional refrigerant channel switching unit 1 with the aforementioned construction, the third refrigerant pipe RP3 downwardly extends from the coupling portion 2. Hence, when the refrigerant is bypassed from the second refrigerant pipe RP2 to the first refrigerant pipe RP1 in a situation such as deactivation of the utilization unit, the refrigerant flows into the third refrigerant pipe RP3 through the coupling portion 2. Thus, the refrigerant and a refrigerator oil are accumulated within the third refrigerant pipe RP3. As a result, there is a concern of degradation in performance of the air conditioning system.

The refrigerant channel switching unit 1 is generally installed in a small and narrow space such as a space above the ceiling. Hence, a casing 4 of the refrigerant channel switching unit 1 is required to be constructed with a compact vertical length d1. Due to the demand for compactness and structural constraints that the switch valves 5 or 6 are required to be mounted to the first refrigerant pipes RP1 and second refrigerant pipes RP2, the conventional refrigerant channel switching unit 1 has had difficulty in distributing the third refrigerant pipe RP3 such that the third refrigerant pipe RP3 upwardly extends from the coupling portion 2.

Additionally, when a plurality of refrigerant channel switching units are provided as described in Japan Laid-open Patent Application Publication NO. 2008-39276, it is desirable to aggregate the plurality of refrigerant channel switching units as an aggregated channel switching unit for convenience of construction. It is demanded to compactly produce the aggregated channel switching unit.

In view of the above, it is an object of the present invention to provide a refrigerant channel switching unit and an aggregated channel switching unit, each of which is good in compactness and by which degradation in performance of an air conditioning system is inhibited.

Solution to Problem

A refrigerant channel switching unit according to a first aspect of the present invention is disposed between a heat source unit and a utilization unit and is configured and arranged to switch flow of refrigerant in a refrigerant circuit formed by the heat source unit and the utilization unit. The refrigerant channel switching unit configured and arranged to include a first refrigerant pipe, a second refrigerant pipe, a third refrigerant pipe, a coupling portion, a first switch valve and a second switch valve. The first refrigerant pipe is connected to a suction gas communicating pipe configured and arranged to extend from the heat source unit. The second refrigerant pipe is connected to a high-low pressure gas communicating pipe configured and arranged to extend from the heat source unit. The third refrigerant pipe is connected to a gas pipe configured and arranged to extend to the utilization unit. The coupling portion is connected to the first refrigerant pipe, the second refrigerant pipe and the third refrigerant pipe. The coupling portion configured and arranged to couple the first refrigerant pipe, the second refrigerant pipe and the third refrigerant pipe therethrough. The first switch valve is mounted to the first refrigerant pipe. The second switch valve is mounted to the second refrigerant pipe. The second switch valve is disposed in a higher position than the first switch valve. The third refrigerant pipe configured and arranged to include a bottom part in a lowest height position of the third refrigerant pipe. The third refrigerant pipe is connected to the coupling portion at the bottom part.

In the refrigerant channel switching unit according to the first aspect of the present invention, the second switch valve, mounted to the second refrigerant pipe, is disposed in a higher position than the first switch valve mounted to the first refrigerant pipe. Additionally, the third refrigerant pipe is connected to the coupling portion at the bottom part of the third refrigerant pipe. Accordingly, it is possible to inhibit increase in vertical length of the entire unit, and simultaneously, produce a structure that the refrigerant flown into the third refrigerant pipe through the coupling portion is unlikely to be accumulated within the third refrigerant pipe when the refrigerant has been bypassed from the second refrigerant pipe to the first refrigerant pipe.

In other words, because the first refrigerant pipe and the second refrigerant pipe are coupled to the third refrigerant pipe at the coupling portion such that the second switch valve is located in a higher position than the first switch valve, it is possible to inhibit increase in vertical length of the entirety, and simultaneously, connect the coupling portion to the bottom part of the third refrigerant pipe. Additionally, because the coupling portion is connected to the bottom part of the third refrigerant pipe, when the refrigerant has been bypassed from the second refrigerant pipe to the first refrigerant pipe, the refrigerant flown into the third refrigerant pipe is likely to flow to the first refrigerant pipe through the coupling portion without being accumulated within the third refrigerant pipe. Therefore, the entire unit is compactly constructed, and simultaneously, the refrigerant and a refrigerator oil are inhibited from being accumulated within the third refrigerant pipe when the refrigerant is bypassed from the second refrigerant pipe to the first refrigerant pipe in a situation such as deactivation of the utilization unit relevant to the refrigerant channel switching unit. Therefore, the refrigerant channel switching unit is good in compactness and inhibits degradation in performance of an air conditioning system.

A refrigerant channel switching unit according to a second aspect of the present invention is disposed between a heat source unit and a utilization unit and is configured and arranged to switch flow of refrigerant in a refrigerant circuit formed by the heat source unit and the utilization unit. The refrigerant channel switching unit configured and arranged to include a first refrigerant pipe, a second refrigerant pipe, a third refrigerant pipe, a coupling portion, a first switch valve and a second switch valve. The first refrigerant pipe is connected to a suction gas communicating pipe configured and arranged to extend from the heat source unit. The second refrigerant pipe is connected to a high-low pressure gas communicating pipe configured and arranged to extend from the heat source unit. The third refrigerant pipe is connected to a gas pipe configured and arranged to extend to the utilization unit. The coupling portion is connected to the first refrigerant pipe, the second refrigerant pipe and the third refrigerant pipe. The coupling portion configured and arranged to couple the first refrigerant pipe, the second refrigerant pipe and the third refrigerant pipe therethrough. The first switch valve is mounted to the first refrigerant pipe. The second switch valve is mounted to the second refrigerant pipe. The first refrigerant pipe includes a horizontally extending part. The horizontally extending part configured and arranged to extend along a horizontal direction. The second refrigerant pipe includes a vertically extending part. The vertically extending part configured and arranged to extend along a vertical direction. The third refrigerant pipe configured and arranged to include a bottom part in a lowest height position of the third refrigerant pipe. The bottom part configured and arranged to extend along an extending direction of the horizontally extending part. The coupling portion is a pipe coupler configured and arranged to have an inverted T shape. The coupling portion is connected to the horizontally extending part, the vertically extending part and the bottom part.

In the refrigerant channel switching unit according to the second aspect of the present invention, the coupling portion is the pipe coupler configured and arranged to have an inverted T shape, and is connected to: the horizontally extending part of the first refrigerant pipe to which the first switch valve is mounted; the vertically extending part of the second refrigerant pipe to which the second switch valve is mounted; and the bottom part of the third refrigerant pipe, which configured and arranged to extend along the extending direction of the horizontally extending part. Accordingly, it is possible to inhibit increase in vertical length of the entire unit, and simultaneously, produce a structure that the refrigerant flown into the third refrigerant pipe through the coupling portion is unlikely to be accumulated within the third refrigerant pipe when the refrigerant has been bypassed from the second refrigerant pipe to the first refrigerant pipe.

In other words, with the construction that the coupling portion is connected to the horizontally extending part and the vertically extending part, the first refrigerant pipe, the second refrigerant pipe and the third refrigerant pipe are coupled such that the second switch valve is located in a higher position than the first switch valve. Also, it is possible to inhibit increase in vertical length of the entirety, and simultaneously, connect the coupling portion to the bottom part of the third refrigerant pipe. Moreover, because the coupling portion is connected to the bottom part of the third refrigerant pipe, the refrigerant flown into the third refrigerant pipe is likely to flow to the first refrigerant pipe through the coupling portion without being accumulated within the third refrigerant pipe when the refrigerant has been bypassed from the second refrigerant pipe to the first refrigerant pipe. Therefore, the entire unit is compactly constructed, and simultaneously, the refrigerant and the refrigerator oil are inhibited from being accumulated within the third refrigerant pipe when the refrigerant is bypassed from the second refrigerant pipe to the first refrigerant pipe in a situation such as deactivation of the utilization unit relevant to the refrigerant channel switching unit. Therefore, the refrigerant channel switching unit is good in compactness and inhibits degradation in performance of an air conditioning system.

The state of that "extend along the extending direction of the horizontally extending part" is not herein limited to a state of extending in completely the same direction as the extending direction of the horizontally extending part. Specifically, when the bottom part tilts with respect to the extending direction of the horizontally extending part at an angle of 10 degrees or less, the bottom part is interpreted as that it "extend along an extending direction of the horizontally extending part".

A refrigerant channel switching unit according to a third aspect of the present invention is the refrigerant channel switching unit according to the first aspect, wherein the first refrigerant pipe configured and arranged to include a horizontally extending part. The horizontally extending part configured and arranged to extend along a horizontal direction. The bottom part configured and arranged to extend along an extending direction of the horizontally extending part. The coupling portion is a pipe coupler configured and arranged to have an inverted T shape. The coupling portion is connected to the horizontally extending part and the bottom part.

In the refrigerant channel switching unit according to the third aspect of the present invention, the coupling portion is the pipe coupler configured and arranged to have an inverted T shape, and is connected to: the horizontally extending part of the first refrigerant pipe to which the first switch valve is mounted; and the bottom part of the third refrigerant pipe, which extends along the extending direction of the horizontally extending part. Because the coupling portion is the pipe coupler configured and arranged to have an inverted T shape and configured and arranged to extend along the same direction as the extending direction of the horizontally extending part and the bottom part (approximately on a straight line on which the horizontally extending part and the bottom part extend), the refrigerant flown into the bottom part is likely to flow to the horizontally extending part when the refrigerant has been bypassed from the second refrigerant pipe to the first refrigerant pipe. Therefore, the refrigerant flown into the third refrigerant pipe becomes more likely to flow to the first refrigerant pipe when the refrigerant has been bypassed from the second refrigerant pipe to the first refrigerant pipe.

The state of that "extend along the extending direction of the horizontally extending part" is not herein limited to a state of extending in completely the same direction as the extending direction of the horizontally extending part. Specifically, when the bottom part tilts with respect to the extending direction of the horizontally extending part at an angle of 10 degrees or less, the bottom part is interpreted as that it "extend along an extending direction of the horizontally extending part".

A refrigerant channel switching unit according to a fourth aspect of the present invention is the refrigerant channel switching unit according to the second or third aspect, wherein in a plan view, the first switch valve and the second switch valve are located on a straight line on which the horizontally extending part or the bottom part extends.

In the refrigerant channel switching unit according to the fourth aspect of the present invention, in a plan view, the first switch valve and the second switch valve are located on the straight line on which the horizontally extending part or the bottom part extends. Accordingly, increase in horizontal length of the entire unit can be inhibited. Therefore, compactness of the entire unit is further promoted.

The state of the first switch valve or the second switch valve that "located on a straight line on which the horizontally extending part or the bottom part extends" is not herein limited to a state of the first switch valve or the second switch valve that completely overlap with the straight line on which the horizontally extending part or the bottom part extends in a plan view. In other words, when the first switch valve or the second switch valve partially overlap with the straight line on which the horizontally extending part or the bottom part extends in a plan view, the first switch valve or the second switch valve is interpreted as being "located on a straight line on which the horizontally extending part or the bottom part extends".

A refrigerant channel switching unit according to a fifth aspect of the present invention is the refrigerant channel switching unit according to any of the first to fourth aspects, wherein the third refrigerant pipe configured and arranged to include a tilt part. The tilt part configured and arranged to extend from the bottom part toward the gas pipe side in an obliquely upwardly tilting posture.

In the refrigerant channel switching unit according to the fifth aspect of the present invention, the third refrigerant pipe configured and arranged to include the tilt part configured and arranged to extend from the bottom part toward the gas pipe side in an obliquely upwardly tilting posture. Accordingly, the refrigerant flown into the third refrigerant pipe through the coupling portion becomes further unlikely to be accumulated within the third refrigerant pipe when the refrigerant has been bypassed from the second refrigerant pipe to the first refrigerant pipe. In other words, because the third refrigerant pipe extends in an obliquely upwardly tilting posture from the bottom part in which the coupling portion is located, the refrigerant flown into the third refrigerant pipe is likely to drop toward the coupling portion side when the refrigerant has been bypassed from the second refrigerant pipe to the first refrigerant pipe. Therefore, the refrigerant and the refrigerator oil are further inhibited from being accumulated within the third refrigerant pipe when the refrigerant is bypassed from the second refrigerant pipe to the first refrigerant pipe in a situation such as deactivation of the utilization unit relevant to the refrigerant channel switching unit.

An aggregated channel switching unit according to a sixth aspect of the present invention includes a casing and the refrigerant channel switching unit according to any of the first to fifth aspects. The plurality of the refrigerant channel switching units configured and arranged to be disposed within the casing In the aggregated channel switching unit according to the sixth aspect of the present invention, the plural refrigerant channel switching units recited in any of the first to fifth aspects are disposed within the casing. By thus aggregating, in the single casing, the plural refrigerant channel switching units which are good in compactness and whereby degradation in performance of the air conditioning system can be inhibited, it is possible to compactly construct the aggregated channel switching unit whereby degradation in performance of the air conditioning system can be inhibited.

Advantageous Effects of Invention

In the refrigerant channel switching unit according to the first aspect of the present invention, the entire unit is compactly constructed, and simultaneously, the refrigerant and the refrigerator oil are inhibited from being accumulated within the third refrigerant pipe when the refrigerant is bypassed from the second refrigerant pipe to the first refrigerant pipe in a situation such as deactivation of the utilization unit relevant to the refrigerant channel switching unit. Therefore, the refrigerant channel switching unit is good in compactness and inhibits degradation in performance of the air conditioning system.

In the refrigerant channel switching unit according to the second aspect of the present invention, the entire unit is compactly constructed, and simultaneously, the refrigerant and the refrigerator oil are inhibited from being accumulated within the third refrigerant pipe when the refrigerant is bypassed from the second refrigerant pipe to the first refrigerant pipe in a situation such as deactivation of the utilization unit relevant to the refrigerant channel switching unit. Therefore, the refrigerant channel switching unit is good in compactness and inhibits degradation in performance of the air conditioning system.

In the refrigerant channel switching unit according to the third aspect of the present invention, the refrigerant flown into the third refrigerant pipe becomes more likely to flow to the first refrigerant pipe when the refrigerant has been bypassed from the second refrigerant pipe to the first refrigerant pipe.

In the refrigerant channel switching unit according to the fourth aspect of the present invention, compactness of the entire unit is further promoted.

In the refrigerant channel switching unit according to the fifth aspect of the present invention, the refrigerant and the refrigerator oil are further inhibited from being accumulated within the third refrigerant pipe when the refrigerant is bypassed from the second refrigerant pipe to the first refrigerant pipe in a situation such as deactivation of the utilization unit relevant to the refrigerant channel switching unit.

In the aggregated channel switching unit according to the sixth aspect of the present invention, it is possible to compactly construct the aggregated channel switching unit whereby degradation in performance of the air conditioning system can be inhibited.

DESCRIPTION OF EMBODIMENT

An air conditioning system 100, including a BS unit 70 and an intermediate unit 130 according to an embodiment of the present invention, will be hereinafter explained with reference to drawings. It should be noted that the following embodiment is a specific example of the present invention, and is not intended to limit the technical scope of the present invention, and can be arbitrarily changed without departing from the scope of the present invention. Additionally, in the following embodiment, the directional terms "up", "down", "left", "right", "front (front side)" and "rear (back side)" mean directions depicted in FIGS. 5 to 15.

(1) Air Conditioning System 100

Figure 1:
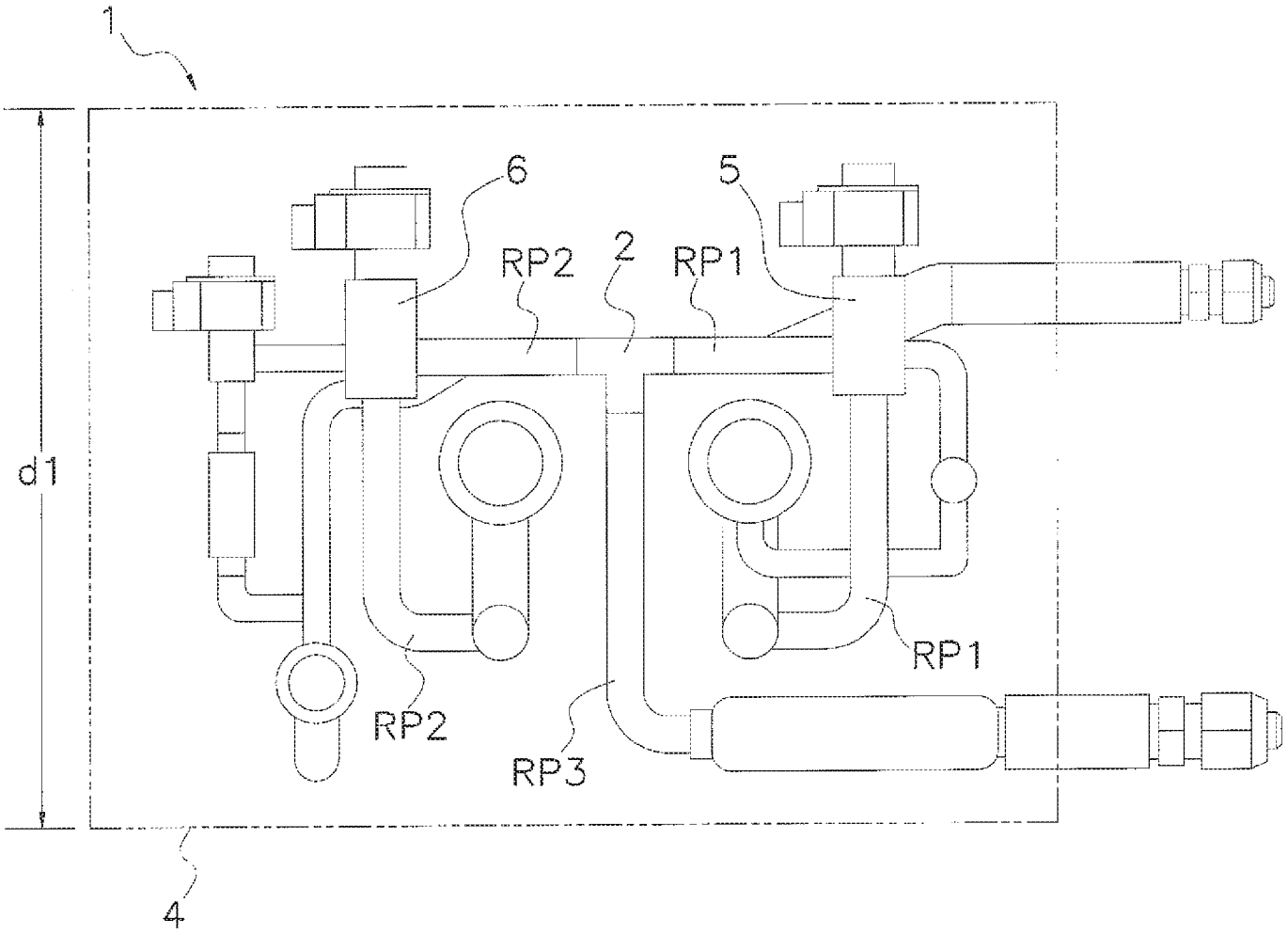
FIG. 1 is a schematic diagram of a conventional refrigerant channel switching unit.
Figure 2:
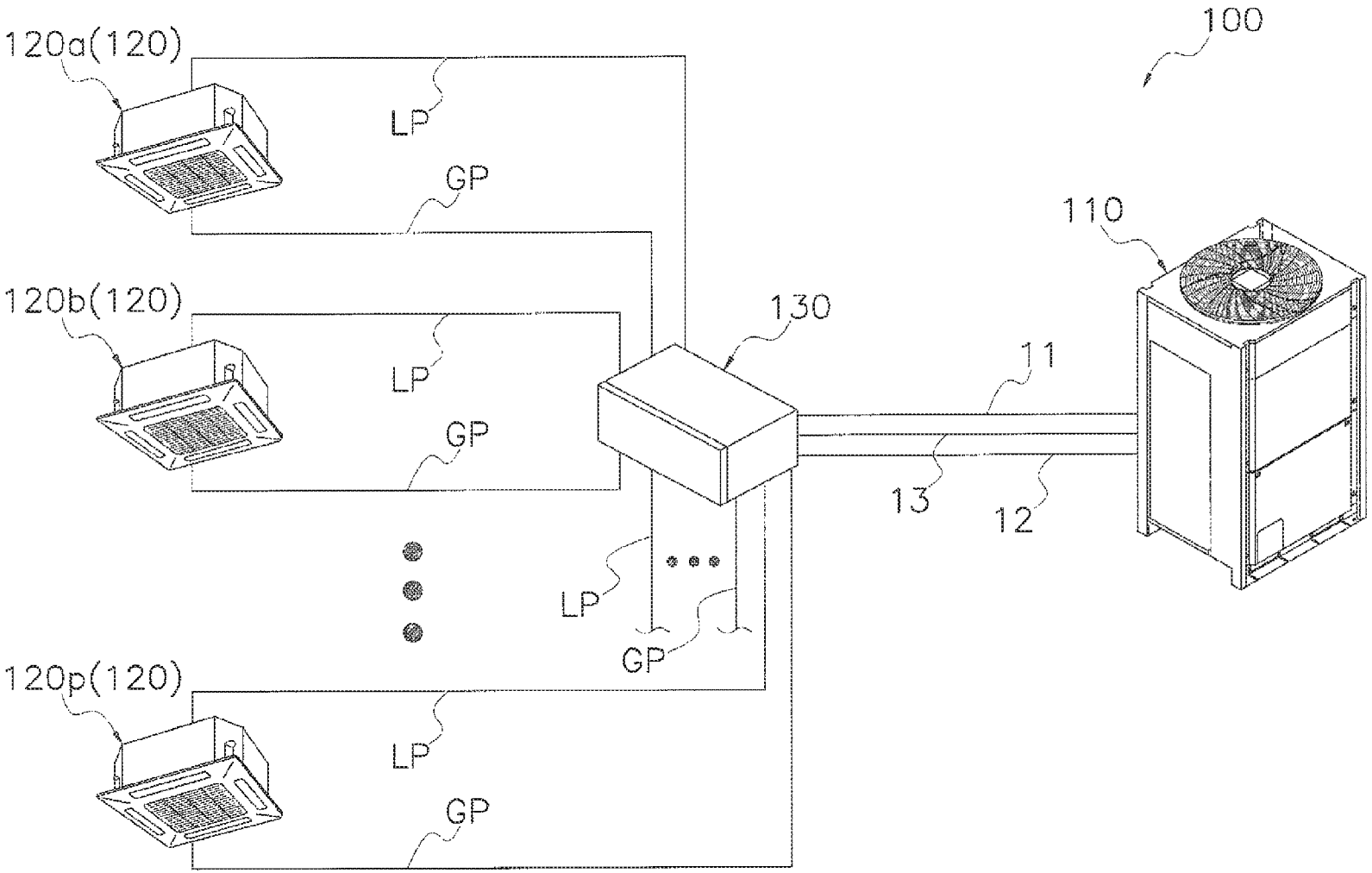
FIG. 2 is a diagram of an entire configuration of an air conditioning system including an intermediate unit.

FIG. 2 is a diagram of an entire configuration of the air conditioning system 100. The air conditioning system 100 is installed in a building, a factory or the like, and implements air conditioning in a target space. The air conditioning system 100, which is an air conditioning system of a refrigerant pipe type, is configured to perform a refrigeration cycle operation of a vapor compression type and performs cooling, heating or the like of the target space.

The air conditioning system 100 mainly includes a single outdoor unit 110 as a heat source unit, a plurality indoor units 120 as utilization units, and the intermediate unit 130 (corresponding to "aggregated channel switching unit" described in claims) configured and arranged to switch flow of refrigerant into the respective indoor units 120. Additionally, the air conditioning system 100 includes a liquid communicating pipe 11, a suction gas communicating pipe 12 and a high-low pressure gas communicating pipe 13 that connect the outdoor unit 110 and the intermediate unit 130, and a plurality of pairs of a liquid pipe LP and a gas pipe GP that connect the intermediate unit 130 and the indoor unit 120.

The air conditioning system 100 is configured to perform the refrigeration cycle operation that the refrigerant encapsulated in a refrigerant circuit is compressed, cooled or condensed, decompressed, heated or evaporated, and then, compressed again. It should be noted that the air conditioning system 100 is of a so-called cooling/heating free type that either a cooling operation or a heating operation is freely selectable in each of the indoor units 120.

The air conditioning system 100 will be hereinafter explained in detail.

(2) Detailed Explanation of Air Conditioning System 100

(2-1) Outdoor Unit 110

Figure 3:
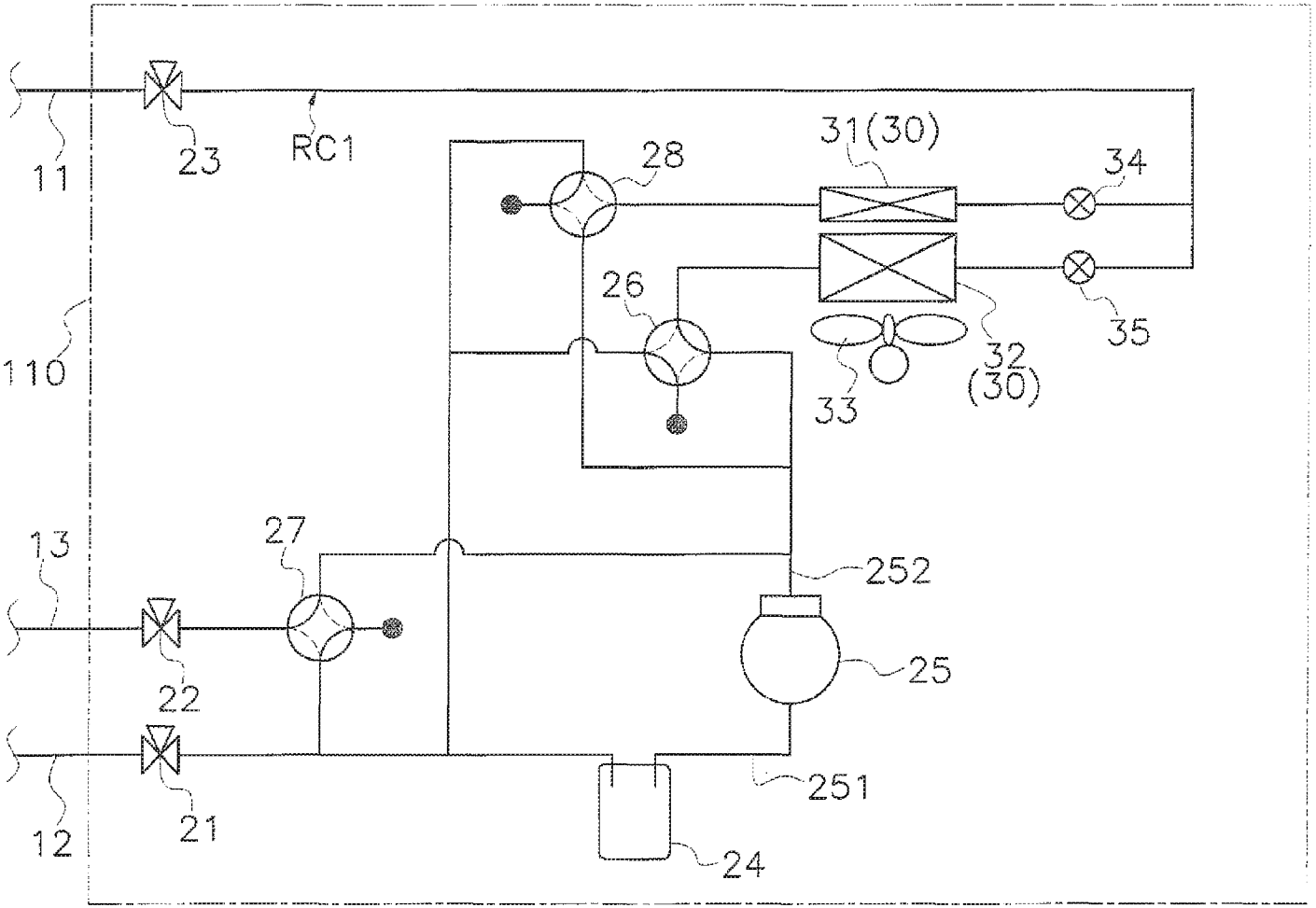
FIG. 3 is a diagram of a refrigerant circuit within an outdoor unit.

FIG. 3 is a diagram of a refrigerant circuit within the outdoor unit 110. The outdoor unit 110 is installed in an outdoor space (e.g., a roof or a veranda of a building) or a basement. A variety of machines are disposed within the outdoor unit 110 and are connected through refrigerant pipes, whereby a heat source-side refrigerant circuit RC1 is formed. The heat source-side refrigerant circuit RC1 is connected to a gas refrigerant circuit RC3 (to be described) and a liquid refrigerant circuit RC4 (to be described), which are provided within the intermediate unit 130, through the liquid communicating pipe 11, the suction gas communicating pipe 12 and the high-low pressure gas communicating pipe 13.

The heat source-side refrigerant circuit RC1 is formed by mainly connecting a first gas-side stop valve 21, a second gas-side stop valve 22, a liquid-side stop valve 23, an accumulator 24, a compressor 25, a first channel switch valve 26, a second channel switch valve 27, a third channel switch valve 28, an outdoor heat exchanger 30, a first outdoor expansion valve 34 and a second outdoor expansion valve 35 through a plurality of refrigerant pipes. Additionally, an outdoor fan 33, an outdoor unit controller (not shown in the drawings) and the like are disposed within the outdoor unit 110.

Machines designed to be disposed within the outdoor unit 110 will be hereinafter explained.

(2-1-1) First Gas-Side Stop Valve 21, Second Gas-Side Stop Valve 22 and Liquid-Side Stop Valve 23

The first gas-side stop valve 21, the second gas-side stop valve 22 and the liquid-side stop valve 23 are manual valves configured to be opened/closed in a refrigerant filling work, a pump-down work, or the like. The first gas-side stop valve 21 is connected at one end to the suction gas communicating pipe 12, and is also connected at the other end to the refrigerant pipe extending to the accumulator 24. The second gas-side stop valve 22 is connected at one end to the high-low pressure gas communicating pipe 13, and is also connected at the other end to the refrigerant pipe extending to the second channel switch valve 27. The liquid-side stop valve 23 is connected at one end to the liquid communicating pipe 11, and is also connected at the other end to the refrigerant pipe extending to either the first outdoor expansion valve 34 or the second outdoor expansion valve 35.

(2-1-2) Accumulator 24

The accumulator 24 is a container for temporarily accumulating the refrigerant at low pressure to be sucked into the compressor 25 and performing gas-liquid separation for the refrigerant. In the interior of the accumulator 24, the refrigerant in a gas-liquid dual-phase state is separated into the gas refrigerant and the liquid refrigerant. The accumulator 24 is disposed between the first gas-side stop valve 21 and the compressor 25. The refrigerant pipe extending from the first gas-side stop valve 21 is connected to a refrigerant inlet of the accumulator 24. A suction pipe 251 extending to the compressor 25 is connected to a refrigerant outlet of the accumulator 24.

(2-1-3) Compressor 25

The compressor 25 has a sealed structure in which a compressor motor is embedded. The compressor 25 is a displacement compressor such as a scroll compressor or a rotary compressor. It should be noted that only one compressor 25 is provided in the present embodiment, however, the number of the compressors 25 is not limited to one, and two or more compressors 25 may be connected in parallel. The suction pipe 251 is connected to a suction port (not shown in the drawings) of the compressor 25. The compressor 25 is configured to suck the refrigerant at low pressure through the suction port, compress the sucked refrigerant, and then discharge the compressed refrigerant through a discharge port (not shown in the drawings). A discharge pipe 252 is connected to the discharge port of the compressor 25.

(2-1-4) First Channel Switch Valve 26, Second Channel Switch Valve 27 and Third Channel Switch Valve 28

The first channel switch valve 26, the second channel switch valve 27 and the third channel switch valve 28 (hereinafter collectively referred to as "channel switch valves SV") are four-way switch valves and are configured to switch the flow of the refrigerant in accordance with conditions (see solid line and broken line in FIG. 3). The discharge pipe 252 or branch pipes extending from the discharge pipe 252 are respectively connected to the refrigerant inlet of each channel switch valve SV. Additionally, each channel switch valve SV is configured to block the flow of the refrigerant in one of the refrigerant channels during operation and practically functions as a three-way valve.

(2-1-5) Outdoor Heat Exchanger 30 and Outdoor Fan 33

The outdoor heat exchanger 30 is a heat exchanger of a cross-fin type or a micro-channel type. The outdoor heat exchanger 30 includes a first heat exchange portion 31 and a second heat exchange portion 32. In the outdoor heat exchanger 30, the first heat exchange portion 31 is mounted to an upper position, whereas the second heat exchange portion 32 is mounted to a lower position than the first heat exchange portion 31.

The first heat exchange portion 31 is connected at one end to the refrigerant pipe that is connected to the third channel switch valve 28, and is also connected at the other end to the refrigerant pipe extending to the first outdoor expansion valve 34. The second heat exchange portion 32 is connected at one end to the refrigerant pipe that is connected to the first channel switch valve 26, and is also connected at the other end to the refrigerant pipe extending to the second outdoor expansion valve 35. The refrigerant passing through the first heat exchange portion 31 and that passing through the second heat exchange portion 32 are configured to exchange heat with airflow to be generated by the outdoor fan 33.

The outdoor fan 33 is a propeller fan, for instance, and is configured to be driven in conjunction with an outdoor fan motor (not shown in the drawings). When the outdoor fan 33 is driven, the airflow, which flows into the outdoor unit 110, passes through the outdoor heat exchanger 30, and flows out from the outdoor unit 110, is generated.

(2-1-6) First Outdoor Expansion Valve 34 and Second Outdoor Expansion Valve 35

Each of the first outdoor expansion valve 34 and the second outdoor expansion valve 35 is, for instance, an electric valve that its opening degree is adjustable. The first outdoor expansion valve 34 is connected at one end to the refrigerant pipe extending from the first heat exchange portion 31, and is also connected at the other end to the refrigerant pipe extending to the liquid-side stop valve 23. The second outdoor expansion valve 35 is connected at one end to the refrigerant pipe extending from the second heat exchange portion 32, and is also connected at the other end to the refrigerant pipe extending to the liquid-side stop valve 23. Each of the first outdoor expansion valve 34 and the second outdoor expansion valve 35 is configured to adjust its opening degree in accordance with conditions, and decompress the refrigerant passing through its interior in accordance with its opening degree.

(2-1-7) Outdoor Unit Controller

The outdoor unit controller is a microcomputer composed of a CPU, a memory and the like. The outdoor unit controller is configured to send/receive signals to/from indoor unit controllers (to be described) and an intermediate unit controller 132 (to be described) through communication lines (not shown in the drawings). In response to received signals and the like, the outdoor unit controller is configured to control activation/deactivation and the rotational speed of the compressor 25 and those of the outdoor fan 33 and is also configured to control opening/closing and opening degree adjustment of a variety of valves.

(2-2) Indoor Units 120

Figure 4:
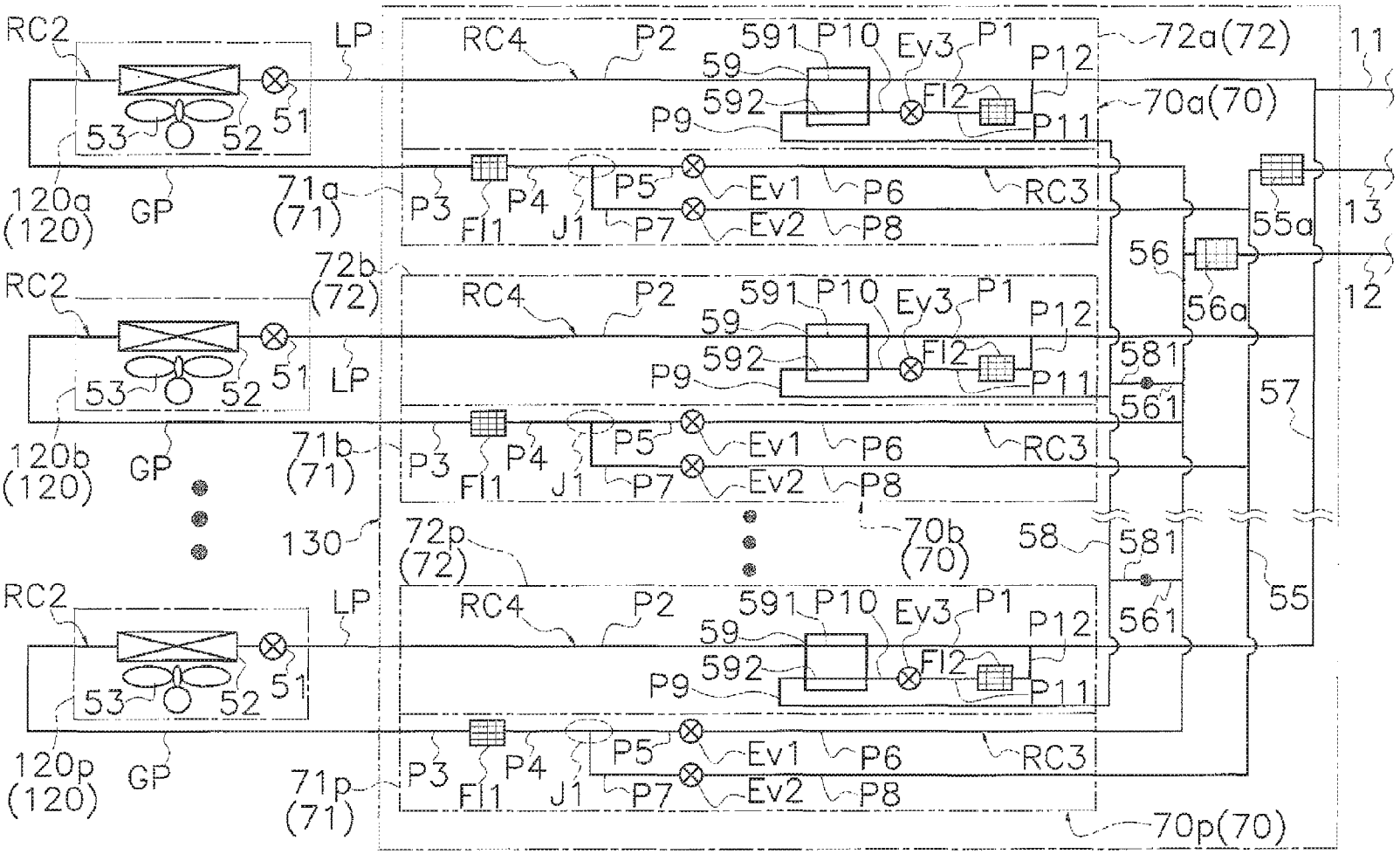
FIG. 4 is a diagram of refrigerant circuits within indoor units and the intermediate unit.

FIG. 4 is a diagram of refrigerant circuits within the indoor units 120 and the intermediate unit 130. Each of the indoor units 120 is of a so-called ceiling embedded type or a so-called ceiling suspended type that is installed in a space above the ceiling or the like, or alternatively, is of a wall mounted type that is mounted to the inner wall of an indoor space or the like. The air conditioning system 100 of the present embodiment includes the plural indoor units 120. Specifically, 16 sets of indoor units (120*a* to 120*p*) are disposed therein.

A utilization-side refrigerant circuit RC2 is formed in each indoor unit 120. In each utilization-side refrigerant circuit RC2, an indoor expansion valve 51 and an indoor heat exchanger 52 are provided, and are connected to each other through a refrigerant pipe. Additionally, an indoor fan 53 and the indoor unit controller (not shown in the drawings) are disposed within each indoor unit 120.

The indoor expansion valve 51 is an electric valve that its opening degree is adjustable. The indoor expansion valve 51 is connected at one end to a relevant one of the liquid pipes LP, and is also connected at the other end to the refrigerant pipe extending to the indoor heat exchanger 52. The indoor expansion valve 51 is configured to decompress the refrigerant passing therethrough in accordance with its opening degree.

The indoor heat exchanger 52 is a heat exchanger of a cross-fin type or a micro-channel type, for instance, and includes a heat transfer tube (not shown in the drawings). The indoor heat exchanger 52 is connected at one end to the refrigerant pipe extending from the indoor expansion valve 51, and is also connected at the other end to a relevant one of the gas pipes GP. The refrigerant, flowing into the indoor heat exchanger 52, exchanges heat with airflow to be generated by the indoor fan 53 when passing through the heat transfer tube.

The indoor fan 53 is, for instance, a cross-flow fan or a sirocco fan. The indoor fan 53 is configured to be driven in conjunction with an indoor fan motor (not shown in the drawings). When the indoor fan 53 is driven, the airflow, which flows into the indoor unit 120 from an indoor space, passes through the indoor heat exchanger 52, and then flows out to the indoor space, is generated.

The indoor unit controller is a microcomputer composed of a CPU, a memory and the like. The indoor unit controller is configured to receive an instruction inputted by a user through a remote controller (not shown in the drawings) and drive the indoor fan 53 and the indoor expansion valve 51 in response to this instruction. Additionally, the indoor unit controller is connected to the outdoor unit controller and the intermediate unit controller 132 (to be described) through a communication line (not shown in the drawings), and is configured to send/receive signals thereto/therefrom.

(2-3) Intermediate Unit 130

Figure 5:
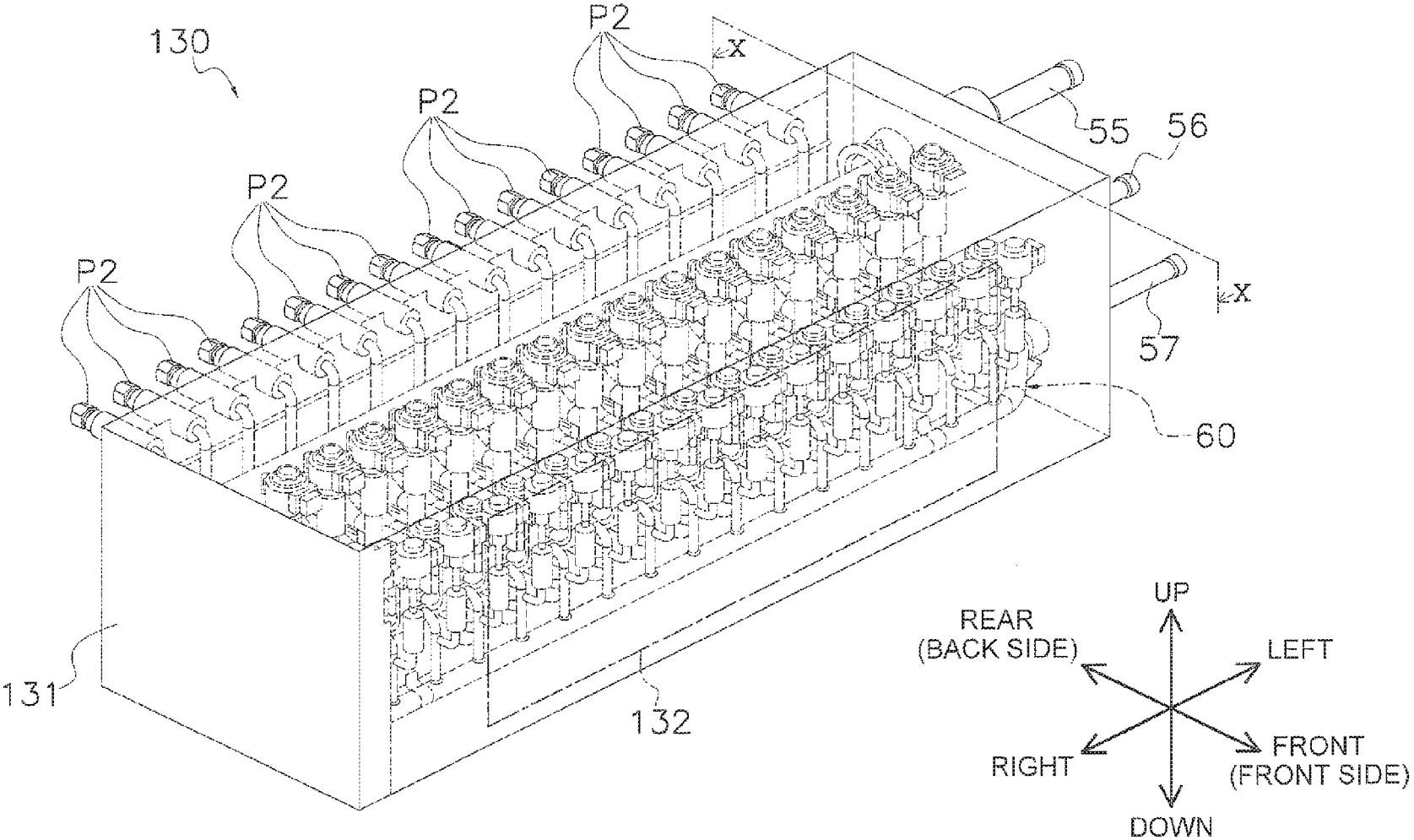
FIG. 5 is a perspective view of the intermediate unit.
Figure 6:
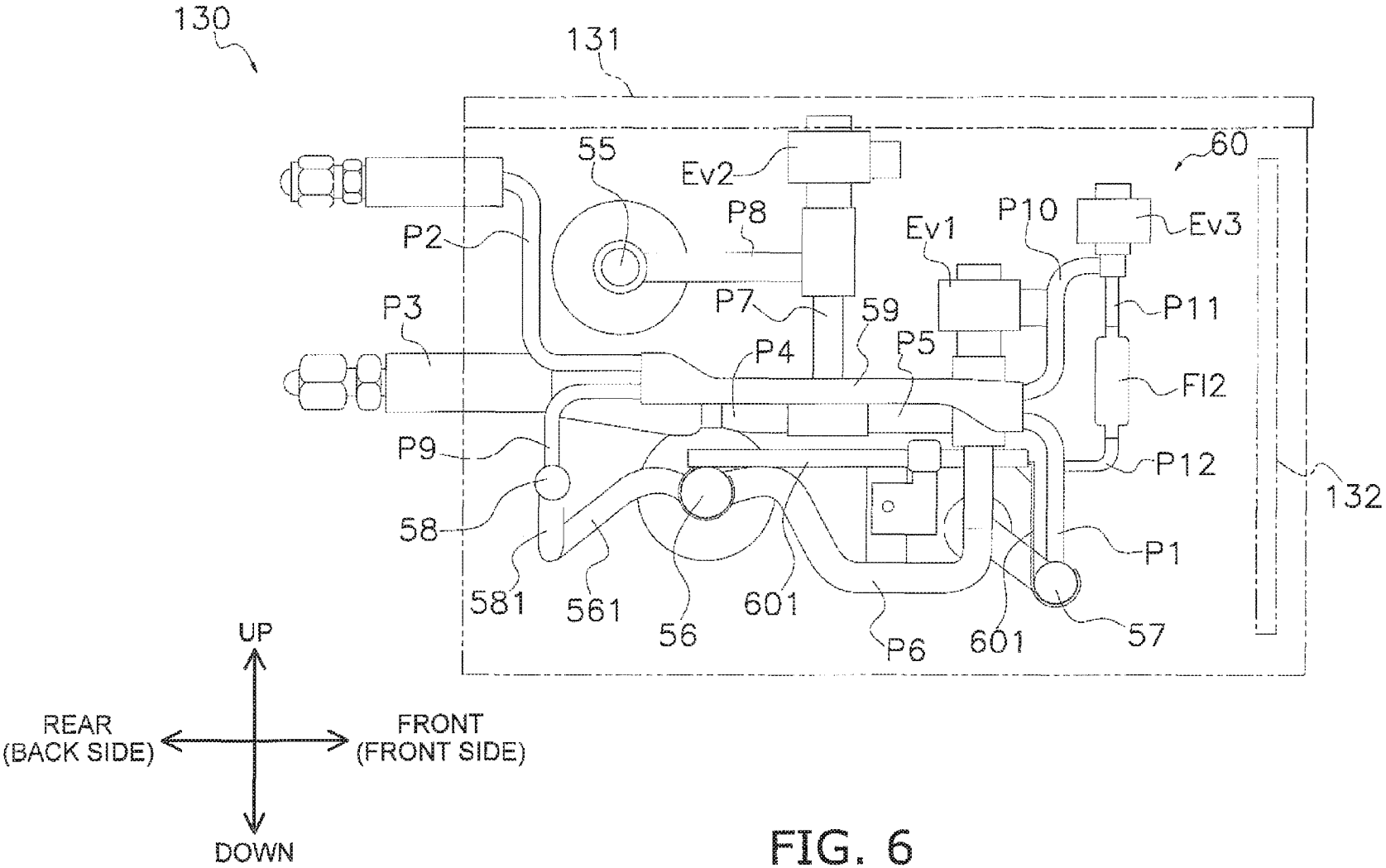
FIG. 6 is a right side view of the intermediate unit.
Figure 7:
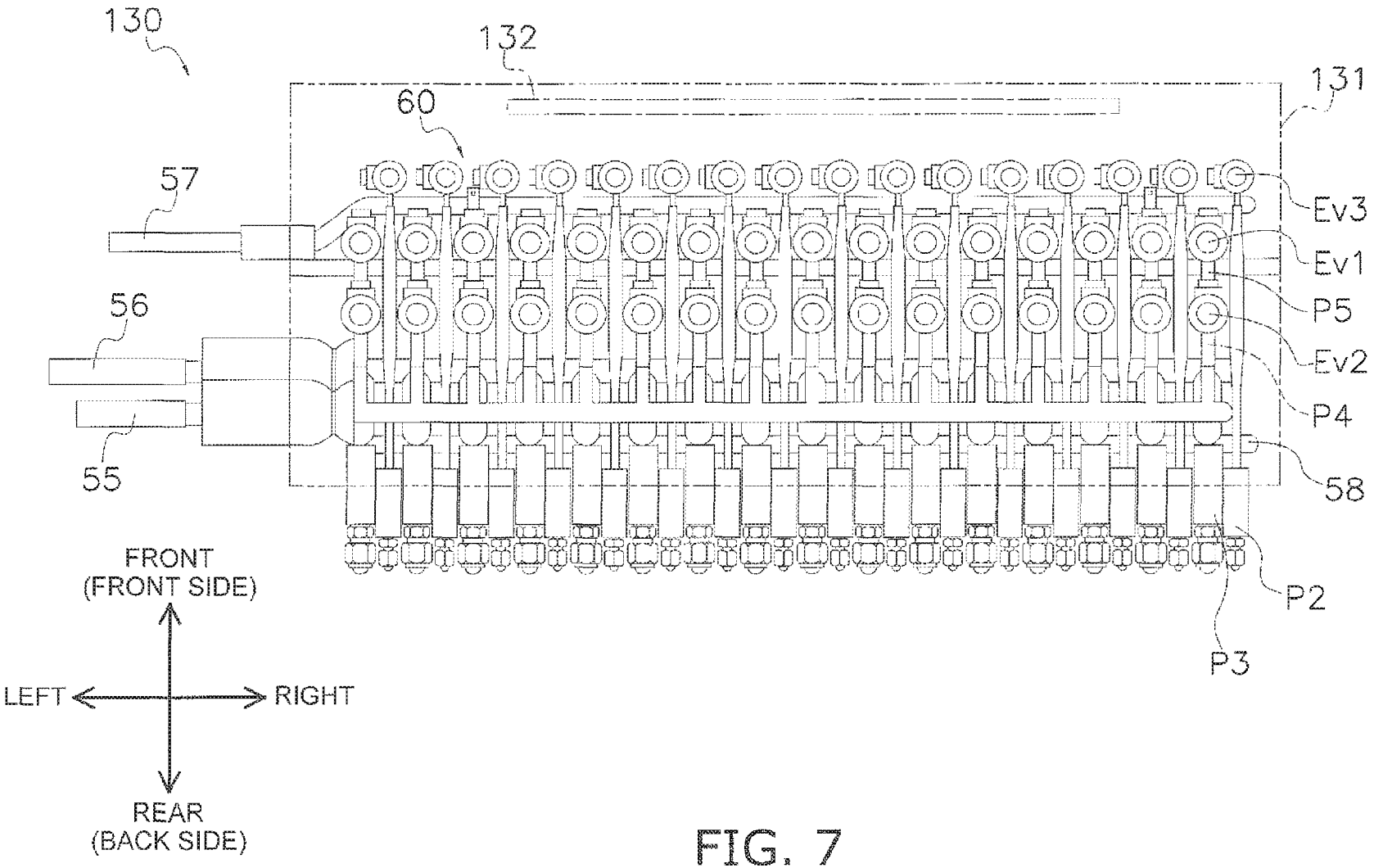
FIG. 7 is a top view of the intermediate unit.
Figure 8:
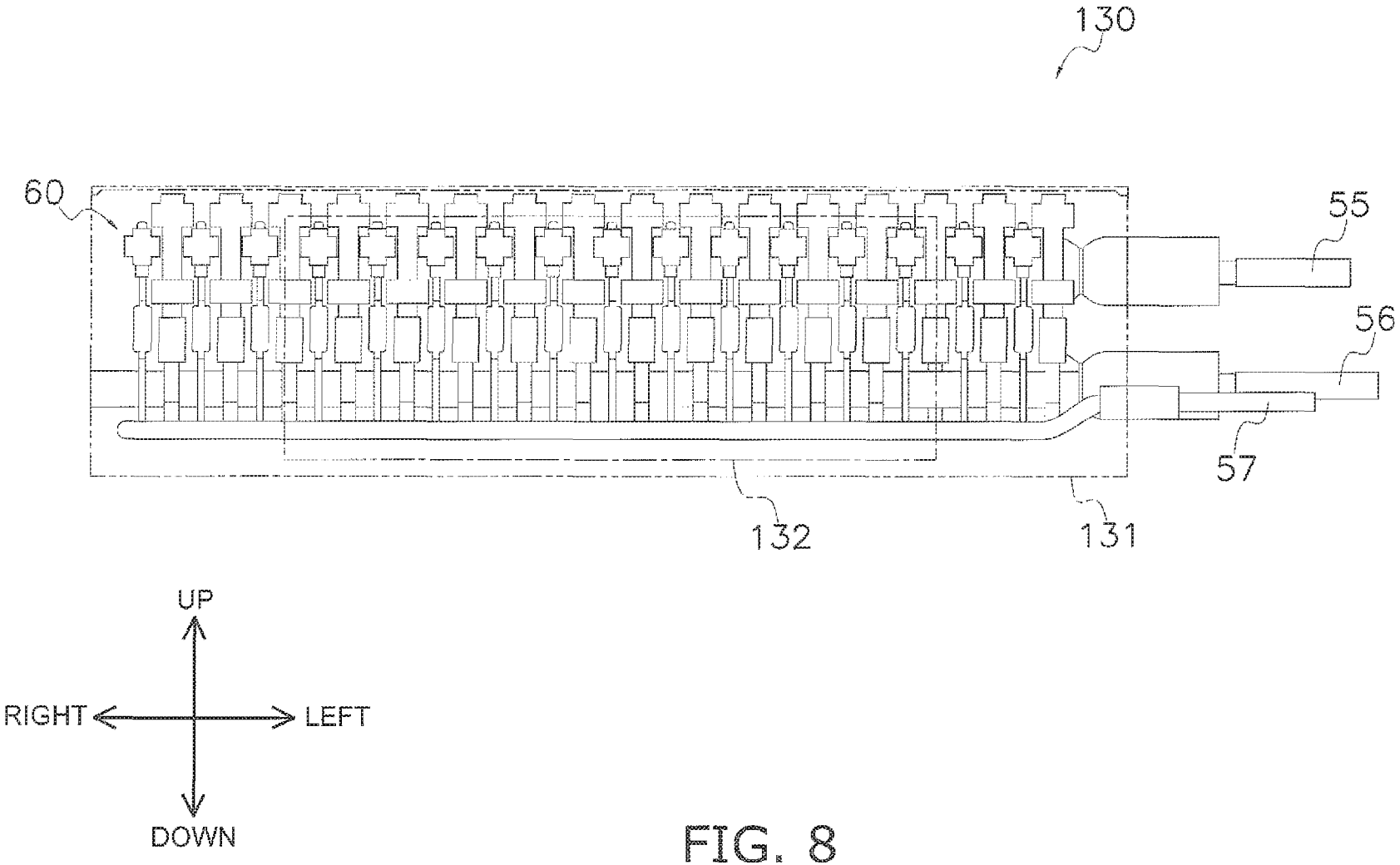
FIG. 8 is a front view of the intermediate unit.
Figure 9:
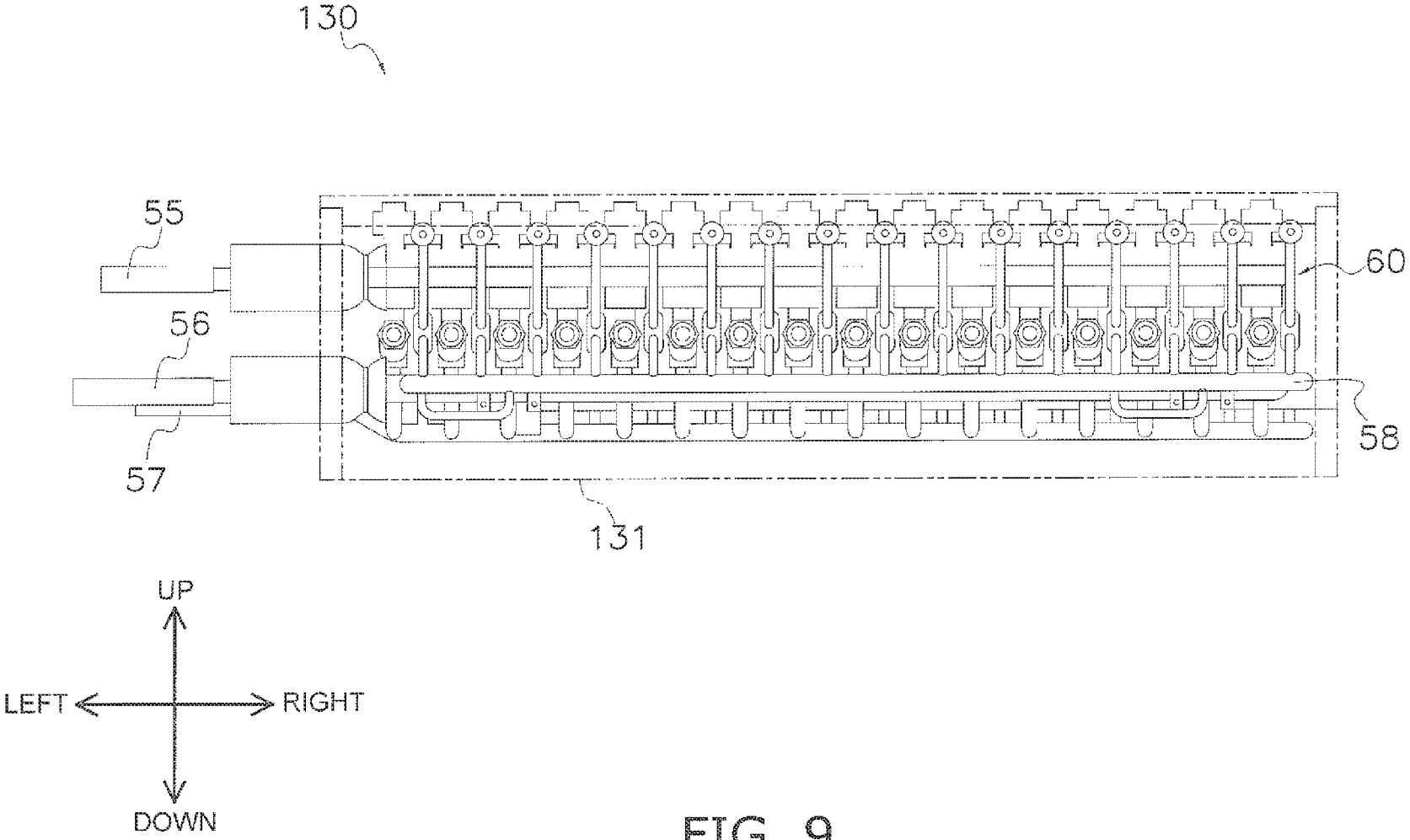
FIG. 9 is a rear view of the intermediate unit.
Figure 10:
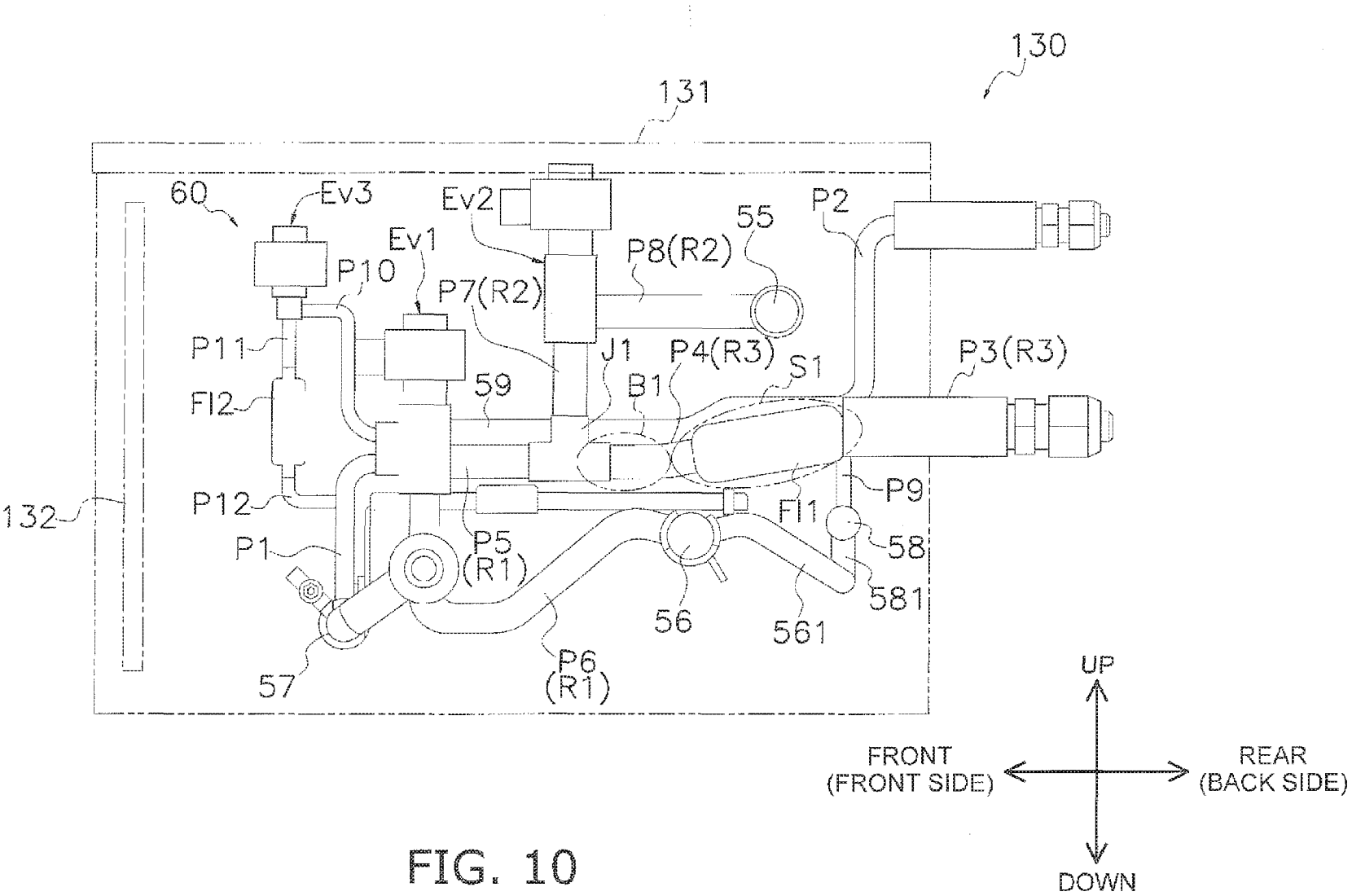
FIG. 10 is a cross-sectional view of FIG. 5 taken along line X-X.

The intermediate unit 130 will be hereinafter explained. FIG. 5 is a perspective view of the intermediate unit 130. FIG. 6 is a right side view of the intermediate unit 130. FIG. 7 is a top view of the intermediate unit 130. FIG. 8 is a front view of the intermediate unit 130. FIG. 9 is a rear view of the intermediate unit 130. FIG. 10 is a cross-sectional view of FIG. 5 taken along line X-X.

The intermediate unit 130 is disposed between the outdoor unit 110 and the respective indoor units 120, and is configured to switch the flow of the refrigerant flowing into the outdoor unit 110 and the flow of the refrigerant flowing into each indoor unit 120. The intermediate unit 130 includes a casing 131 made of metal. The casing 131 is made in an approximately cubical shape, and a drain pan (not shown in the drawings) is detachably mounted to the bottom of the casing 131. The casing 131 mainly accommodates a BS unit assembly 60 and the intermediate unit controller 132.

(2-3-1) BS Unit Assembly 60

Figure 11:
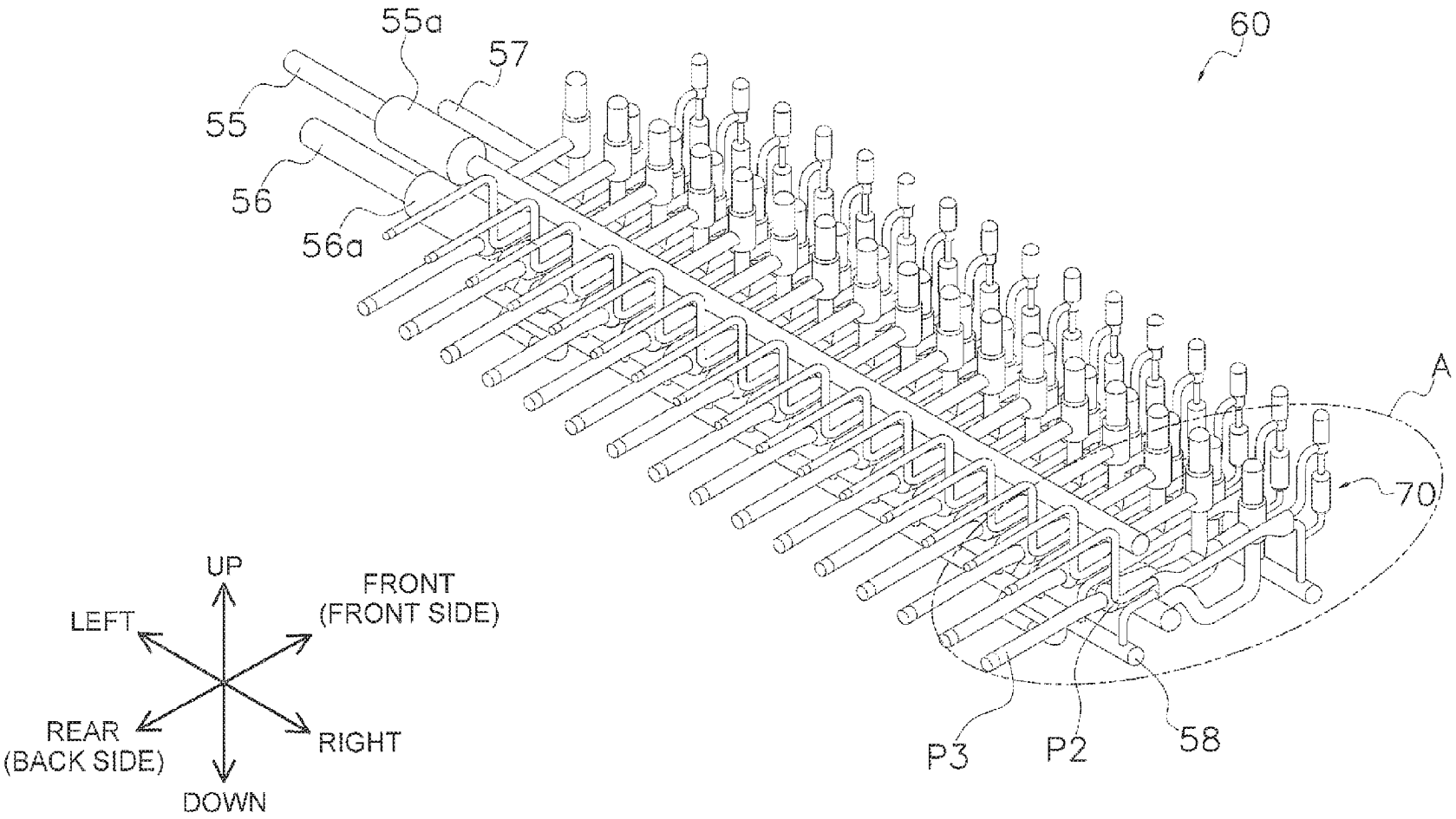
FIG. 11 is a perspective view of a BS unit assembly.
Figure 12:
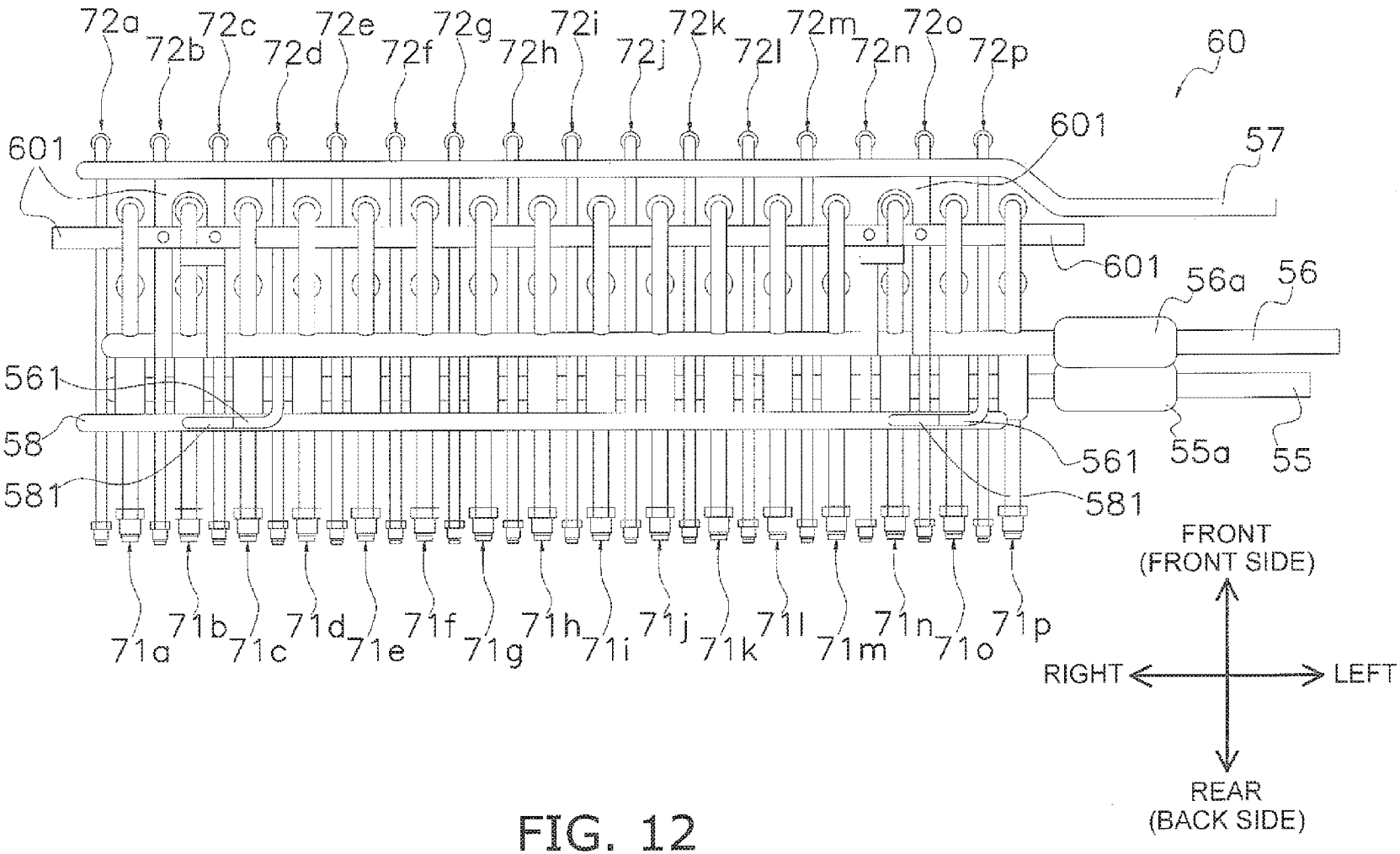
FIG. 12 is a bottom view of the BS unit assembly.

FIG. 11 is a perspective view of the BS unit assembly 60. FIG. 12 is a bottom view of the BS unit assembly 60.

Figure 13:
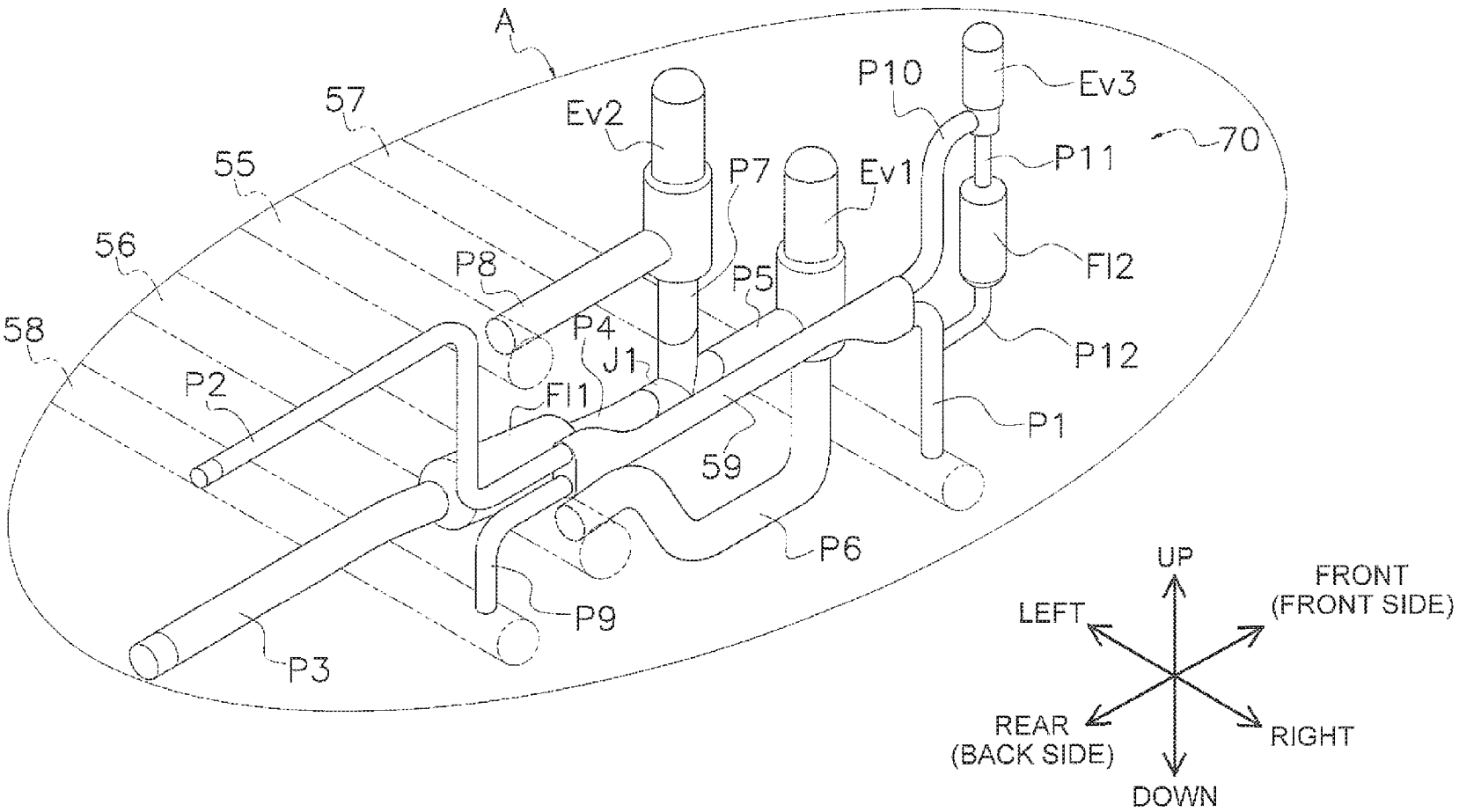
FIG. 13 is an enlarged view of a BS unit illustrated in a region A of FIG. 11.

As shown in FIG. 11, FIG. 12 and the like, the BS unit assembly 60 is constructed by the combination of a plurality of refrigerant pipes, electric valves and the like. The BS unit assembly 60 is conceptually assembled by aggregating a plurality of the BS units 70, each of which is shown in FIG. 13. In the present embodiment, the BS unit assembly 60 includes a plurality of headers (a first header 55, a second header 56, a third header 57 and a fourth header 58) and the BS units 70, the number of which is the same as that of the indoor units 120. Specifically, the BS unit assembly 60 includes 16 sets of the BS units 70*a* to 70*p* (see FIG. 4, etc.).

(2-3-1-1) First Header 55, Second Header 56, Third Header 57 and Fourth Header 58

The first header 55 is connected to and communicated with the high-low pressure gas communicating pipe 13. The first header 55 includes a first header filter 55*a* in the vicinity of its connected part to the high-low pressure gas communicating pipe 13 (see FIG. 11). The first header filter 55*a* is configured to remove foreign objects contained in the refrigerant passing therethrough. The first header 55 is connected approximately perpendicularly to an eighth pipe P8 of each first unit 71 to be described.

The second header 56 is connected to and communicated with the suction gas communicating pipe 12. The second header 56 includes a second header filter 56*a* in the vicinity of its connected part to the suction gas communicating pipe 12 (see FIG. 11). The second header filter 56*a* is configured to remove foreign objects contained in the refrigerant passing therethrough. Additionally, the second header 56 is connected approximately perpendicularly to a sixth pipe P6 of each first unit 71 to be described.

Moreover, the second header 56 includes first connecting parts 561 located right and left. The first connecting parts 561 are connected to second connecting parts 581 (to be described) of the fourth header 58. The second header 56 is communicated with the fourth header 58 through these first connecting parts 561 (see FIGS. 12 and 16). Each first connecting part 561 gently extends upward from the second header 56, then curves and extends downward (see FIGS. 6 and 10). Each first connecting part 561 thus upwardly extends from the second header 56 in order to form a trap for inhibiting the refrigerant existing in the second header 56 and the refrigerator oil compatibly mixed with the refrigerant from flowing into each first connecting part 561 in a situation such as deactivation of the air conditioning system 100.

The third header 57 is connected to and communicated with the liquid communicating pipe 11. The third header 57 is connected approximately perpendicularly to a first pipe P1 of each liquid communicating unit 73 to be described.

The fourth header 58 is connected approximately perpendicularly to a ninth pipe P9 of each bypass unit 74 to be described. Additionally, the fourth header 58 includes the second connecting parts 581 located right and left. The second connecting parts 581 are connected to the first connecting parts 561 of the second header 56. The fourth header 58 is communicated with the second header 56 through these second connecting parts 581 (see FIGS. 12 and 16).

The first header 55, the second header 56, the third header 57 and the fourth header 58 extend along the right-and-left direction (horizontal direction). The first header 55, the second header 56 and the third header 57 are exposed to the outside via through holes bored in the left lateral surface of the casing 131. Additionally, regarding the positional relation among the headers in the height direction, the first header 55, the fourth header 58, the second header 56 and the third header 57 are aligned from top to bottom in this sequential order (see FIGS. 6 and 10). On the other hand, regarding the positional relation among the headers in the back-and-forth direction, the fourth header 58, the first header 55, the second header 56 and the third header 57 are aligned in this sequential order from the back side to the front side (see FIGS. 6 and 10).

It should be noted that the first header 55, the second header 56, the third header 57 and the fourth header 58 extend in approximately parallel to each other.

(2-3-1-2) BS Units 70

The BS units 70 are associated with the indoor units 120 on a one-to-one basis. For example, the BS unit 70*a* is associated with the indoor unit 120*a*, the BS unit 70*b* is associated with the indoor unit 120*b*, and the BS unit 70*p* is associated with the indoor unit 120*p*. Each BS unit 70 will be explained in detail in "(3) Detailed Explanation of BS Unit 70" to be described.

(2-3-2) Intermediate Unit Controller 132

The intermediate unit controller 132 is a microcomputer composed of a CPU, a memory and the like. The intermediate unit controller 132 is configured to receive a signal from either each indoor unit controller or the outdoor unit controller through the communication line and control opening/closing of each of a first electric valve Ev1 (to be described), a second electric valve Ev2 (to be described) and a third electric valve Ev3 (to be described) in accordance with this signal.

(3) Detailed Explanation of BS Unit 70

Each BS unit 70 (corresponding to "refrigerant channel switching unit" described in claims) will be hereinafter explained in detail. FIG. 13 is an enlarged view of each BS unit 70 shown in a region A of FIG. 11.

Each BS unit 70 is disposed between the outdoor unit 110 and its relevant indoor unit 120, and is configured and arranged to switch the flow of the refrigerant. Each BS unit 70 is mainly composed of the first unit 71 shown in FIG. 14 and a second unit 72 shown in FIG. 15.

(3-1) First Unit 71

Figure 14:
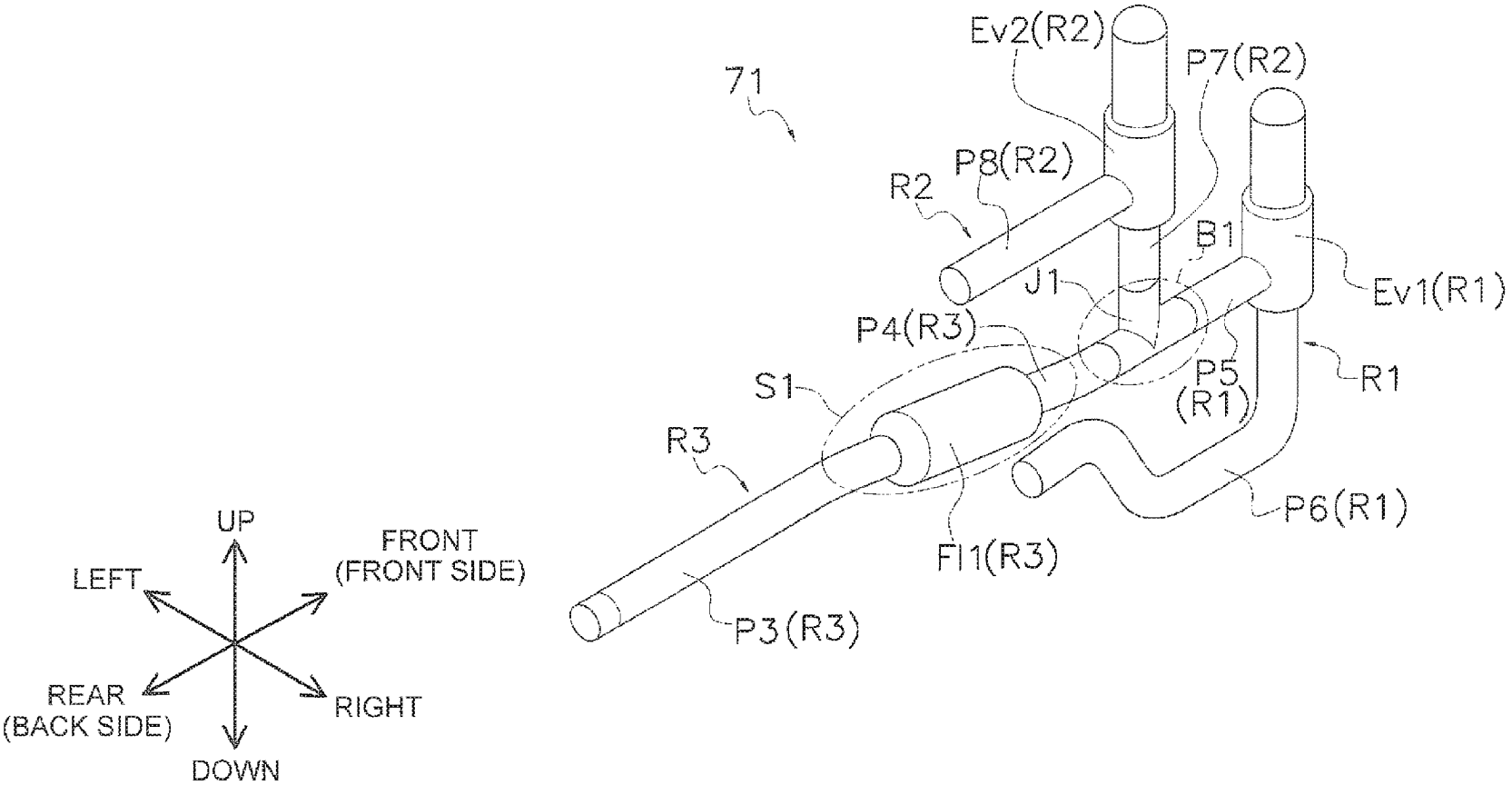
FIG. 14 is a perspective view of a first unit.

FIG. 14 is a perspective view of the first unit 71. The first unit 71 is a unit for composing the gas refrigerant circuit RC3 within each BS unit 70.

The first unit 71 is connected to the high-low pressure gas communicating pipe 13 through the first header 55, is connected to the suction gas communicating pipe 12 through the second header 56, and is connected to its relevant utilization-side refrigerant circuit RC2 through s relevant gas pipe GP. The first unit 71 is mainly configured to cause the gas refrigerant to flow between either the high-low pressure gas communicating pipe 13 or the suction gas communicating pipe 12 and its relevant utilization-side refrigerant circuit RC2.

The first unit 71 includes the first electric valve Ev1 and the second electric valve Ev2 as switch valves. Additionally, the first unit 71 includes a first filter F11 and a coupling portion J1. Moreover, the first unit 71 includes a third pipe P3, a fourth pipe P4, a fifth pipe P5, the sixth pipe P6, a seventh pipe P7 and the eighth pipe P8 as refrigerant pipes. It should be noted that in the present embodiment, not electro-magnetic valves but electric valves (the first electric valve Ev1 and the second electric valve Ev2) are employed as switch valves in order to inhibit sound of the refrigerant passing through the interior of the first unit 71.

The first unit 71 is mainly divided into a first part R1 (corresponding to "first refrigerant pipe" described in claims), a second part R2 (corresponding to "second refrigerant pipe" described in claims) and a third part R3 (corresponding to "third refrigerant pipe" described in claims). The first unit 71 is constructed by coupling the first part R1, the second part R2 and the third part R3 through the coupling portion J1.

(3-1-1) First Part R1

The first part R1 is connected at one end to the suction gas communicating pipe 12 through the second header 56, and is also coupled at the other end to the second part R2 and the third part R3 through the coupling portion J1. Specifically, the first part R1 is a part including the first electric valve Ev1, the fifth pipe P5 and the sixth pipe P6. It should be noted that from another perspective of view, the first part R1 can be regarded as a single refrigerant pipe connected to the suction gas communicating pipe 12 (i.e., the first part R1 corresponds to "first refrigerant pipe" described in claims).

The first electric valve Ev1 is an electric valve that its opening degree is adjustable, for instance, and is configured to switch the flow of the refrigerant by allowing or blocking passage of the refrigerant in accordance with its opening degree. As shown in FIG. 14 (a drive part of the first electric valve Ev1 is not shown in FIG. 14), the first electric valve Ev1 is made in an approximately columnar shape, and is disposed in a posture that its lengthwise direction is oriented in the up-and-down direction (vertical direction). The first electric valve Ev1 is connected at one end to the fifth pipe P5, and is also connected at the other end to the sixth pipe P6. It should be noted that in a plan view the first electric valve Ev1 is located on a straight line on which a bottom part B1 (to be described) of the fourth pipe P4 and the fifth pipe P5 extend (see FIG. 7, etc.).

The fifth pipe P5 (corresponding to "horizontally extending part" described in claims) is connected at one end to the coupling portion J1, and is also connected at the other end to the first electric valve Ev1. More specifically, the fifth pipe P5 forwardly (horizontally) extends from the one end (its connected part to the coupling portion J1) and is connected at the other end to the first electric valve Ev1 (see FIGS. 13 and 14).

The sixth pipe P6 is connected at one end to the second header 56, and is also connected at the other end to the first electric valve Ev1. More specifically, the sixth pipe P6 gently extends upward from the one end (i.e., its connected part to the second header 56), then curves and extends downward, further curves and extends forward (horizontally), yet further curves and extends upward (vertically), and is connected at the other end to the first electric valve Ev1 (see FIGS. 6, 10, 13 and 14). The sixth pipe P6 thus upwardly extends partially from its connected part to the second header 56 in order to form a trap for inhibiting the refrigerant existing in the second header 56 and the refrigerator oil compatibly mixed with the refrigerant from flowing into the sixth pipe P6 in a situation such as deactivation of the air conditioning system 100. It should be noted that the sixth pipe P6 is connected approximately perpendicularly to the second header 56.

(3-1-2) Second Part R2

The second part R2 is connected at one end to the high-low pressure gas communicating pipe 13 through the first header 55, and is also coupled at the other end to the first part R1 and the third part R3 through the coupling portion J1. Specifically, the second part R2 is a part including the second electric valve Ev2, the seventh pipe P7 and the eighth pipe P8. It should be noted that from another perspective of view, the second part R2 can be regarded as a single refrigerant pipe connected to the high-low pressure gas communicating pipe 13 (i.e., the second part P2 corresponds to "second refrigerant pipe" described in claims).

The second electric valve Ev2 is, for instance, an electric valve that its opening degree is adjustable. More specifically, the second electric valve Ev2 is formed a minute channel (not shown in the drawings) in its interior, and enables the refrigerant to flow through the minute channel even when its opening degree is minimized. Thus, the second electric valve Ev2 is configured not to be completely closed even when its opening degree is minimized. As shown in FIG. 14 (a drive part of the second electric valve Ev2 is not shown in FIG. 14), the second electric valve Ev2 is made in an approximately columnar shape, and is disposed in a posture that its lengthwise direction is oriented in the up-and-down direction (vertical direction). The second electric valve Ev2 is connected at one end to the seventh pipe P7, and is also connected at the other end to the eighth pipe P8. It should be noted that as shown in FIG. 10 and the like, the second electric valve Ev2 is disposed rearward of and above (in a higher position than) the first electric valve Ev1. Additionally, in the plan view, the second electric valve Ev2 is located on the line on which the bottom part B1 (to be described) of the fourth pipe and the fifth pipe P5 extend (see FIG. 7, etc.).

The seventh pipe P7 (corresponding to "vertically extending part" described in claims) is connected at one end to the coupling portion J1, and is also connected at the other end to the second electric valve Ev2. More specifically, the seventh pipe P7 upwardly (vertically) extends from the one end (i.e., its connected part to the coupling portion J1) and is connected at the other end to the second electric valve Ev2 (see FIGS. 13 and 14).

The eighth pipe P8 is connected at one end to the second electric valve Ev2, and is also connected at the other end to the first header 55. More specifically, the eighth pipe P8 extends rearward (horizontally) from the one end (i.e., its connected part to the second electric valve Ev2) and is connected at the other end approximately perpendicularly to the first header 55 (see FIGS. 13 and 14).

(3-1-3) Third Part R3

The third part R3 is connected at one end to its relevant gas pipe GP, and is also coupled at the other end to the first part R1 and the second part R2 through the coupling portion J1. Specifically, the third part R3 is a part including the first filter F11, the third pipe P3 and the fourth pipe P4. It should be noted that from another perspective of view, the third part R3 can be regarded as a single refrigerant pipe connected to its relevant gas pipe GP (i.e., the third part R3 corresponds to "third refrigerant pipe" described in claims).

The first filter 111 is for removing foreign objects contained in the refrigerant passing therethrough. As shown in FIG. 14, the first filter F11 is made in an approximately columnar shape, and is disposed in a posture that its lengthwise direction is oriented in the back-and-forth direction (horizontal direction). More specifically, the first filter F11 is disposed in a tilting posture that its back side end is located in a higher position than its front side end (see FIG. 6, FIG. 10, etc.). The first filter F11 is connected at one end to the third pipe P3, and is also connected at the other end to the fourth pipe P4.

The third pipe P3 is connected at one end to its relevant gas pipe GP, and is also connected at the other end to the first filter F11. When explained in more detail, the third pipe P3 extends from the other end (its connected part to the first filter F11) to the back side in an obliquely upwardly tilting posture and then horizontally (backwardly) extends (see FIG. 10, etc.). It should be noted that the one end of the third pipe P3 is exposed to the outside from the back side of the casing 131 (see FIG. 6, FIG. 10, etc.).

The fourth pipe P4 is connected at one end to the first filter F11, and is also connected at the other end to the coupling portion J1. When explained in more detail, the fourth pipe P4 extends from the one end (its connected part to the first filter F11) to the front side in an obliquely downwardly tilting posture, then horizontally (forwardly) extends, and is connected at the other end to the coupling portion J1 (see FIG. 10, etc.).

It should be noted that as described above, the first filter F11 is disposed in a tilting posture, and simultaneously, the third pipe P3 and the fourth pipe P4 extend in tilting postures, whereby a tilt part S1 is constructed in the third part R3 as shown in FIGS. 10 and 14. Specifically, the tilt part S1 is composed of the tilt part of the third pipe P3, the first filter F11 and the tilt part of the fourth pipe P4. The tilt part S1 tilts such that its back side is located in a higher position than its front side.

Additionally, the bottom part B1 is constructed by providing the tilt part S1 in the third part R3. As shown in FIG. 10, the tilt part S1 extends from the bottom part B1 toward the one end of the third pipe P3 (toward the gas pipe GP) in an obliquely upwardly tilting posture. The bottom part B1 is a part located in the lowest height position within the third part R3. More specifically, the bottom part B1 refers to a horizontally extending part of the fourth pipe P4. In other words, the bottom part B1 extends along the extending direction of the fifth pipe P5. The third part R3 is connected at the bottom part B1 to the coupling portion J1.

(3-1-4) Coupling Portion J1

The coupling portion J1 is a pipe coupler for refrigerant pipes configured and arranged to have an inverted T shape. The coupling portion J1 is designed to enable three pipes to be connected thereto through openings bored upward, forward and backward. The coupling portion J1 is connected to the fifth pipe P5 of the first part R1, the seventh pipe P7 of the second part R2, and the bottom part B1 (the fourth pipe P4) of the third part R3 by flare fittings, brazing or the like.

Specifically, the coupling portion J1 is connected to the first part R1 through the forwardly bored opening, is connected to the second part R2 through the upwardly bored opening, and is connected to the third part R3 through the backwardly bored opening. By connecting the coupling portion J1 to the first part R1, the second part R2 and the third part R3 in this aspect, the respective parts are sequentially located in the order of the first part R1, the second part R2 and the third part R3 from the front side to the back side as shown in FIG. 10 and the like.

(3-2) Second Unit 72

Figure 15:
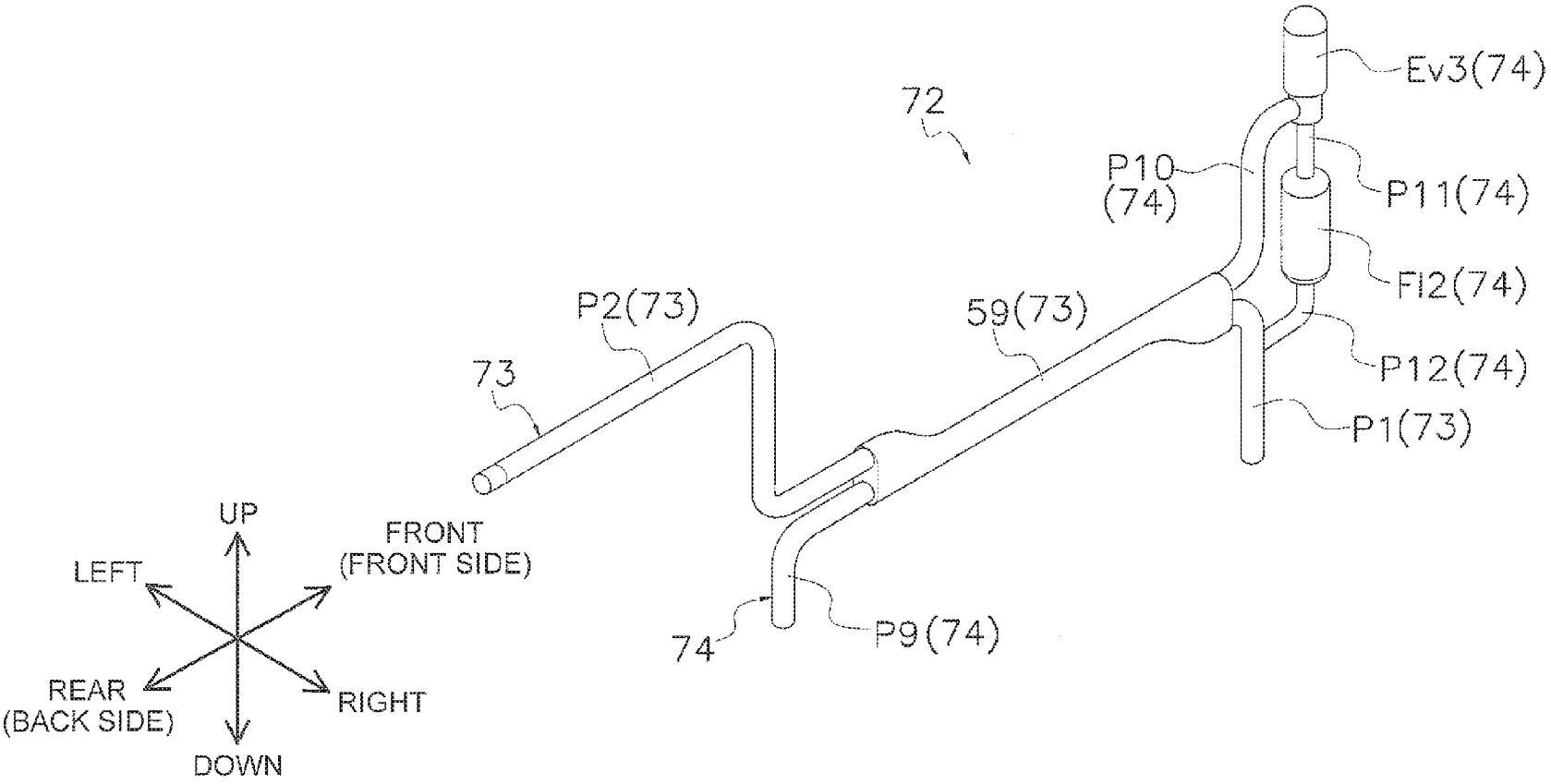
FIG. 15 is a perspective view of a second unit.

FIG. 15 is a perspective view of the second unit 72. The second unit 72 is mainly divided into the liquid communicating unit 73 and the bypass unit 74.

(3-2-1) Liquid Communicating Unit 73

The liquid communicating unit 73 is a unit for composing the liquid refrigerant circuit RC4 within each BS unit 70.

The liquid communicating unit 73 is connected to the liquid communicating pipe 11 through the third header 57, and is also connected to its relevant utilization-side refrigerant circuit RC2 through its relevant liquid pipe LP. The liquid communicating unit 73 mainly causes the liquid refrigerant to flow between the liquid communicating pipe 11 and its relevant utilization-side refrigerant circuit RC2. The liquid communicating unit 73 mainly includes a supercooling heat exchange portion 59 and the first pipe P1 and a second pipe P2 as refrigerant pipes.

(3-2-1-1) Supercooling Heat Exchange Portion 59

The supercooling heat exchange portion 59 is, for instance, a heat exchanger of a two-nested-pipe type. The supercooling heat exchange portion 59 is made in an approximately tubular shape, and is formed a first channel 591 and a second channel 592 in the interior thereof. More specifically, the supercooling heat exchange portion 59 has a structure that enables heat exchange between the refrigerant flowing through the first channel 591 and the refrigerant flowing through the second channel 592. The first channel 591 is connected at one end to the first pipe P1, and is also connected at the other end to the second pipe P2. The second channel 592 is connected at one end to the ninth pipe P9, and is also connected at the other end to a tenth pipe P10.

The supercooling heat exchange portion 59 is disposed in a posture that it extends along the back-and-forth direction (horizontal direction). It should be noted that in the BS unit assembly 60 shown in FIG. 11, each supercooling heat exchange portion 59 extends in approximately parallel to each third pipe P3, each fourth pipe P4 and the like.

(3-2-1-2) Refrigerant Pipes within Liquid Communicating Unit 73

The first pipe P1 is connected at one end to the third header 57, and is also connected at the other end to the first channel 591 of the supercooling heat exchange portion 59. Specifically, the first pipe P1 upwardly (vertically) extends from the one end (i.e., its connected part to the third header 57) and is connected at the other end to the supercooling heat exchange portion 59 (see FIGS. 13 and 15). It should be noted that the first pipe P1 is connected approximately perpendicularly to the third header 57.

The second pipe P2 is connected at one end to the first channel 591 of the supercooling heat exchange portion 59, and is also connected at the other end to its relevant liquid pipe LP. Specifically, the second pipe P2 extends rearward (horizontally) from the one end (i.e., its connected part to the supercooling heat exchange portion 59), then curves and extends upward (vertically), and further curves and extends rearward (horizontally) (see FIGS. 13 and 15). It should be noted that the other end of the second pipe P2 is exposed to the outside from the back side of the casing 131 (see FIG. 6, FIG. 10, etc.).

(3-2-2) Bypass Unit 74

The bypass unit 74 is a unit for bypassing the refrigerant from the fourth header 58 to the liquid communicating unit 73. Specifically, the bypass unit 74 is connected at one end to the fourth header 58, and is also connected at the other end to the first pipe P1 of the liquid communicating unit 73. The bypass unit 74 bypasses the gas refrigerant, which has passed through the sixth pipe P6 of the first unit 71 and has then flown into the fourth header 58 through the second header 56, to the first pipe P1 of the liquid communicating unit 73.

The bypass unit 74 mainly includes the third electric valve Ev3, a second filter F12, and ninth, tenth, eleventh and twelfth pipes P9, P10, P11 and P12 as refrigerant pipes.

(3-2-2-1) Third Electric Valve Ev3

The third electric valve Ev3 is an electric valve that its opening degree is adjustable, for instance, and is configured to switch the flow of the refrigerant by allowing or blocking passage of the refrigerant in accordance with its opening degree. As shown in FIG. 15 (a drive part of the third electric valve Ev3 is not shown in FIG. 15), the third electric valve Ev3 is made in an approximately columnar shape, and is disposed in a posture that its lengthwise direction is oriented in the up-and-down direction (vertical direction). Specifically, the third electric valve Ev3 is connected at one end to the tenth pipe P10, and is also connected at the other end to the eleventh pipe P11.

(3-2-2-2) Second Filter F12

The second filter F12 is for removing foreign objects contained in the refrigerant passing therethrough. As shown in FIG. 15, the second filter F12 is made in an approximately columnar shape, and is disposed in a posture that its lengthwise direction is oriented in the up-and-down direction (vertical direction). Specifically, the second filter F12 is connected at one end to the eleventh pipe P11, and is also connected at the other end to the twelfth pipe P12.

(3-2-2-3) Refrigerant Pipes within Bypass Unit 74

The ninth pipe P9 is connected at one end to the fourth header 58, and is also connected at the other end to the second channel 592 of the supercooling heat exchange portion 59. Specifically, the ninth pipe P9 upwardly (vertically) extends from the one end (i.e., its connected part to the fourth header 58), curves and extends forward (horizontally), and is connected to the supercooling heat exchange portion 59 (see FIGS. 13 and 15). It should be noted that the ninth pipe P9 is connected approximately perpendicularly to the fourth header 58.

The tenth pipe P10 is connected at one end to the second channel 592 of the supercooling heat exchange portion 59, and is also connected at the other end to the third electric valve Ev3. Specifically, the tenth pipe P10 upwardly (vertically) extends from the one end (i.e., its connected part to the supercooling heat exchange portion 59), and is connected at the other end to the third electric valve Ev3 (see FIGS. 13 and 15).

The eleventh pipe P11 is connected at one end to the third electric valve Ev3, and is also connected at the other end to the second filter F12. Specifically, the eleventh pipe P11 downwardly (vertically) extends from its part connected to the third electric valve Ev3, and is connected at the other end to the second filter F12 (see FIGS. 13 and 15).

The twelfth pipe P12 is connected at one end to the second filter F12, and is also connected at the other end to the first pipe P1. Specifically, the twelfth pipe P12 downwardly (vertically) extends from the one end (i.e., its connected part to the second filter F12), curves and extends rearward (horizontally), and is connected at the other end to the first pipe P1 (see FIGS. 13 and 15).

(4) Refrigerant Flow During Operation of Air Conditioning System 100

Refrigerant flow during operation of the air conditioning system 100 will be hereinafter explained for various conditions in which the indoor units 120*a* and 120*b* are assumed to be under operation.

It should be noted that in the following explanation, the other indoor units 120 (120*c* to 120*p*) are assumed to be under deactivation to make explanation simple. Due to this, the indoor expansion valves 51 in the indoor units 120 except for the indoor units 120*a* and 120*b* are assumed to be fully closed, and the first electric valves Ev1 and the third electric valves Ev3 in the BS units 70 except for the BS units 70*a* and 70*b* (i.e., BS units 70*c* to 70*p*) are assumed to be fully closed. Additionally, the second electric valves Ev2 in the BS units 70*c* to 70*p* are assumed to be opened at the minimum opening degree, and thus, the refrigerant existing in the second part R2 (the eighth pipe P8 and the seventh pipe P7) is configured to be bypassed to the first part R1 (the fifth pipe P5 and the like) through the minimally opened channel.

(4-1) Condition that Both Indoor Units 120*a* and 120*b* Perform Cooling Operation Under this condition, in each of the BS units 70*a* and 70*b*, the first electric valve Ev1 is configured to be frilly opened and the second electric valve Ev2 is configured to be opened at the minimum opening degree. Additionally, the indoor expansion valve 51 in each of the indoor units 120*a* and 120*b* is configured to be opened at an appropriate opening degree, and the first outdoor expansion valve 34 and the second outdoor expansion valve 35 are configured to be frilly opened.

When the compressor 25 is driven under the aforementioned condition, the high-pressure gas refrigerant produced by compression of the compressor 25, flows into the outdoor heat exchanger 30 through the discharge pipe 252, the first channel switch valve 26, the third channel switch valve 28 and the like, and condenses therein. The refrigerant, which has condensed in the outdoor heat exchanger 30, passes through the liquid-side stop valve 23 and the like, and flows into the liquid communicating pipe 11. The refrigerant, which has flown into the liquid communicating pipe 11, reaches the third header 57 of the intermediate unit 130 in due course, and flows into the first pipe P1 of the BS unit 70*a* or 70*b* (the second unit 72*a* or 72*b*).

The refrigerant, which has flown into the first pipe P1, flows through the second pipe P2, the relevant liquid pipe LP and the like, reaches the indoor unit 120*a* or 120*b*, flows into the indoor expansion valve 51, and is decompressed therein. The decompressed refrigerant flows into each indoor heat exchanger 52 and evaporates therein. The evaporated refrigerant flows into the third pipe P3 of the BS unit 70*a* or 70*b* (the first unit 71*a* or 71*b*) through the gas pipe GP.

The refrigerant, which has flown into the third pipe P3, flows through the fourth pipe P4, the fifth pipe P5, the sixth pipe P6 and the like, and reaches the second header 56. The refrigerant, which has reached the second header 56, flows into the outdoor unit 110 through the suction gas communicating pipe 12 and is sucked into the compressor 25.

It should be noted that when the indoor unit 120*a* or 120*b* is deactivated due to a thermo-off function or the like, the refrigerant existing in the second part R2 (the eighth pipe P8 and the seventh pipe P7) is bypassed to the first part R1 the fifth pipe P5 and the like) through the minute channel of the second electric valve Ev2 and the like.

(4-2) Condition that Both Indoor Units 120*a* and 120*b* Perform Heating Operation Under this condition, in each of the BS units 70*a* and 70*b*, the first electric valve Ev1 is configured to be fully closed, whereas the second electric valve Ev2 is configured to be fully opened. Additionally, the indoor expansion valve 51 in each of the indoor units 120*a* and 120*b* is configured to be fully opened, and each of the first outdoor expansion valve 34 and the second outdoor expansion valve 35 is configured to be opened at an appropriate opening degree.

When the compressor 25 is driven under the aforementioned condition, the high-pressure gas refrigerant produced by compression of the compressor 25, flows into the high-low pressure gas communicating pipe 13 through the discharge pipe 252, the second channel switch valve 27 and the like. The refrigerant, which has flown into the high-low pressure gas communicating pipe 13, reaches the first header 55 of the intermediate unit 130 in due course. The refrigerant, which has reached the first header 55, flows into the eighth pipe P8 of the BS unit 70*a* or 70*b* (the first unit 71*a* or 71*b*) and then flows into the gas pipe OP through the seventh pipe P7, the fourth pipe P4, the third pipe P3 and the like.

The refrigerant, which has flown into the gas pipe GP reaches the indoor unit 120*a* or 120*b*, flows into each indoor heat exchanger 52, and condenses therein. The condensed refrigerant flows into the second pipe P2 of the BS unit 70*a* or 70*b* (the second unit 72*a* or 72*b*) through the liquid pipe LP.

The refrigerant, which has flown into the second pipe P2, reaches the third header 57 through the first pipe P1 and the like. The refrigerant, which has reached the third header 57, flows into the outdoor unit 110 through the liquid communicating pipe 11.

The refrigerant, which has flown into the outdoor unit 110, is decompressed in the first outdoor expansion valve 34 or the second outdoor expansion valve 35. The decompressed refrigerant flows into the outdoor heat exchanger 30 and evaporates therein while passing through the outdoor heat exchanger 30. The evaporated refrigerant is sucked into the compressor 25 through the first channel switch valve 26 or the third channel switch valve 28 and the like.

(4-3) Condition that One Indoor Unit 120*a*/120*b* Performs Cooling Operation Whereas Other Indoor Unit 120*b*/120*a* Performs Heating Operation Under this condition, in one of the BS units 70*a* and 70*b* (hereinafter referred to as "one BS unit 70") associated with one of the indoor units 120 performing a cooling operation (hereinafter referred to as "one indoor unit 120"), the first electric valve Ev1 is configured to be fully opened, the second electric valve Ev2 is configured to be opened at the minimum opening degree, and the third electric valve Ev3 is configured to be opened at an appropriate opening degree. Additionally, in one indoor unit 120, the indoor expansion valve 51 is configured to be opened at an appropriate opening degree. In comparison with this, the other of the BS units 70*a* and 70*b* (hereinafter referred to as the other BS unit 70") associated with the other of the indoor units 120 performing a heating operation (hereinafter referred to as "the other indoor unit 120"), the first electric valve Ev1 is configured to be fully closed and the second electric valve Ev2 is configured to be fully opened. Additionally, in the other indoor unit 120, the indoor expansion valve 51 is configured to be fully opened. Moreover, each of the first outdoor expansion valve 34 and the second outdoor expansion valve 35 is configured to be opened at an appropriate opening degree.

When the compressor 25 is driven under the aforementioned condition, the high-pressure gas refrigerant produced by compression of the compressor 25, flows into the high-low pressure gas communicating pipe 13 through the discharge pipe 252, the second channel switch valve 27 and the like. The refrigerant, which has flown into the high-low pressure gas communicating pipe 13, reaches the first header 55 of the intermediate unit 130 in due course. The refrigerant, which has reached the first header 55, flows into the first unit 71 in the other BS unit 70, and flows into the gas pipe GP through the eighth pipe P8, the seventh pipe P7, the fourth pipe P4, the third pipe P3 and the like.

The refrigerant, which has flown into the relevant gas pipe GP, reaches the other indoor unit 120, flows into the indoor heat exchanger 52, and condenses therein. The condensed refrigerant flows into the second pipe P2 of the liquid communicating unit 73 in the other BS unit 70 through the liquid pipe LP. The refrigerant, which has flown into the second pipe P2, reaches the third header 57 through the first pipe P1 and the like.

The refrigerant, which has reached the third header 57, reaches the liquid communicating unit 73 in the one BS unit 70 and flows into the first pipe P1. The refrigerant, which has flown into the first pipe P1, passes through the first channel 591 of the supercooling heat exchange portion 59 and reaches the one indoor unit 120 through the second pipe P2 and the liquid pipe LP.

The refrigerant, which has reached the one indoor unit 120, flows into the indoor expansion valve 51 and is decompressed therein. The decompressed refrigerant flows into the indoor heat exchanger 52 and evaporates therein. The evaporated refrigerant reaches the first unit 71 of the one BS unit 70 through the gas pipe GP and flows into the third pipe P3. The refrigerant, which has flown into the third pipe P3, flows through the fourth pipe P4, the fifth pipe P5, the sixth pipe P6 and the like, and reaches the second header 56.

Part of the refrigerant having reached the second header 56 flows into the outdoor unit 110 through the suction gas communicating pipe 12 and is sucked into the compressor 25. On the other hand, the rest of the refrigerant having reached the second header 56 flows into the fourth header 58 through the pairs of the first connecting part 561 and the second connecting part 581. In other words, the pairs of the first connecting part 561 and the second connecting part 581 play a role of connecting pipes that connect the second header 56 and the fourth header 58 and feed the refrigerant within the second header 56 to the fourth header 58.

The refrigerant, which has flown into the fourth header 58, reaches the bypass unit 74 in the one BS unit 70 and flows into the ninth pipe P9. The refrigerant, which has flown into the ninth pipe P9, flows into the second channel 592 of the supercooling heat exchange portion 59. The ref which has flown into the second channel 592, exchanges heat with the refrigerant passing through the first channel 591 when passing through the second channel 592, whereby the refrigerant passing through the first channel 591 is cooled. Accordingly, the refrigerant flowing through the first channel 591 is in a supercooled state.

The refrigerant, which has passed through the second channel 592, flows through the tenth pipe P10, the eleventh pipe P11, the twelfth pipe P12 and the like, and joins the refrigerant flowing through the first pipe P1.

It should be noted that when the one indoor unit 120 is deactivated due to a thermo-off function or the like, the refrigerant, existing in the second part P2 (the eighth pipe P8 and the seventh pipe P7) of the one BS unit 70, is bypassed to the first part R1 (the fifth pipe P5 and the like) through the minute channel of the second electric valve Ev2 and the like.

(5) Method of Manufacturing Intermediate Unit 130

Figure 16:
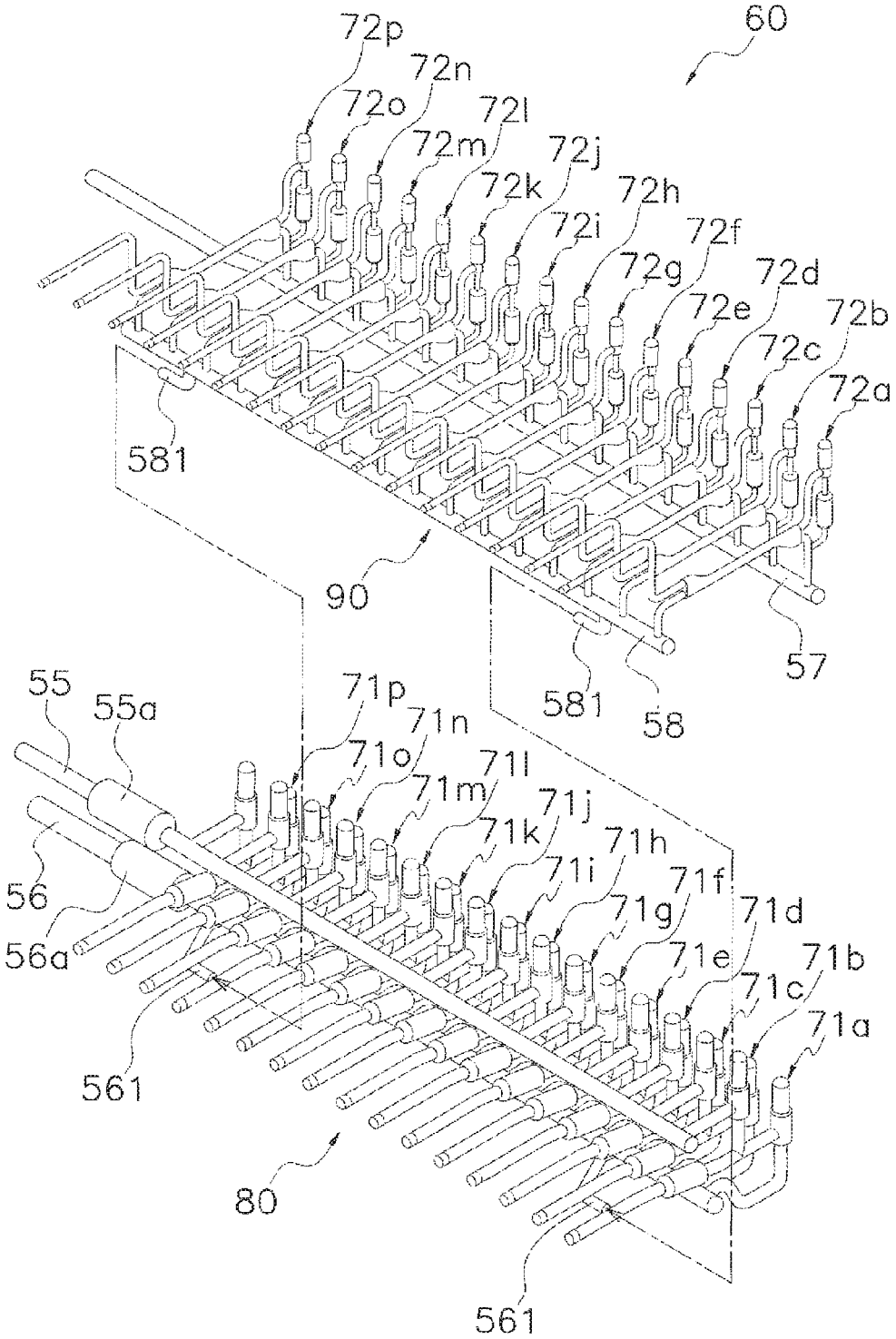
FIG. 16 is an exploded view of the BS unit assembly.

A method of manufacturing the intermediate unit 130 will be herein explained. FIG. 16 is an exploded view of the BS unit assembly 60.

The intermediate unit 130 is mainly manufactured by combining separately fabricated components such as the casing 131, the intermediate unit controller 132 and the BS unit assembly 60 including the plural BS units 70, in a production line.

Specifically, the BS unit assembly 60 is mounted onto the bottom side of the casing 131 manufactured by sheet metal working, and is suitably fixed thereto by screws and the like. Afterwards, the intermediate unit controller 132 is accommodated in the casing 131, and wiring connection between the intermediate unit controller 132 and the first, second and third electric valves Ev1, Ev2 and Ev3 and the like are performed. Finally, a drain pan and the like are mounted to the casing 131, and then, the top side and the front side part of the casing 131 are fixed by screws and the like.

It should be noted that as shown in FIG. 16, the BS unit assembly 60 is fabricated by combining a first assembly 80 assembled by integrating the plural first units 71 (71*a* to 71*p*) and a second assembly 90 assembled by integrating the plural second units 72 (72*a* to 72*p*) and then by fixing the combined first and second assemblies 80 and 90 with a fixing tool 601 (see FIGS. 6 and 12).

(6) Features (6-1)

In the aforementioned embodiment, in each BS unit 70 (the first unit 71), the second electric valve Ev2, mounted to the second part R2, is disposed in a higher position than the first electric valve Ev1 mounted to the first part R1. Additionally, the third part R3 is connected to the coupling portion J1 at the bottom part B1.

Thus, the first part R1 and the second part R2 are connected to the coupling portion J1 such that the second electric valve Ev2 is located in a higher position than the first electric valve Ev1. Hence, it is possible to inhibit increase in vertical length of each entire BS unit 70 and connect the third part R3 to the coupling portion J1 at the bottom part B1.

Additionally, the coupling portion J1 is thus connected to the bottom part B1 of the third part R3. Hence, when the refrigerant has been bypassed from the second part R2 to the first part R1 in deactivation or the like, the refrigerant flown into the third part R3 is likely to flow to the first part R1 through the coupling portion J1 without being accumulated within the third part R3.

Therefore, the BS units 70 and the intermediate unit 130 are compactly constructed, and simultaneously, the refrigerant and the refrigerator oil are inhibited from being accumulated within the third part R3 when the refrigerant is bypassed from the second part R2 to the first part R1 in a situation such as deactivation of the indoor unit 120 relevant to each BS unit 70.

(6-2)

In the aforementioned embodiment, the coupling portion J1 is a pipe coupler configured and arranged to have an inverted T shape, and is connected to: the fifth pipe P5 of the first part R1 to which the first electric valve Ev1 is mounted; the seventh pipe P7 of the second part R2 to which the second electric valve Ev2 is mounted; and the bottom part B1 of the third part R3 which extends along the extending direction of the fifth pipe P5.

Thus, the coupling portion J1 is connected to the fifth pipe P5 extending along the horizontal direction and the seventh pipe P7 extending along the vertical direction. Accordingly, the first part the second part R2 and the third part R3 can be coupled such that the second electric valve Ev2 is located in a higher position than the first electric valve Ev1. Additionally, it is possible to inhibit increase in vertical length of the entirety, and simultaneously, to connect the coupling portion J1 to the bottom part B1 of the third part R3.

Moreover, the coupling portion J1 is a pipe coupler configured and arranged to have an inverted T shape, and the fifth pipe P5 and the bottom part B1 are extends along the same direction (approximately on a straight line). Accordingly, the refrigerant flown into the bottom part B1 is likely to flow to the fifth pipe P5 when the refrigerant has been bypassed from the second part R2 to the first part R1.

(6-3)

In the aforementioned embodiment, in a plan view, the first electric valve Ev1 and the second electric valve Ev2 are located on the straight line on which the fifth pipe P5 and the bottom part B1 extend. Accordingly, increase in horizontal length of the entirety can be inhibited.

(6-4)

In the aforementioned embodiment, in each BS unit 70 (the first unit 71), the third part R3 includes the tilt part S1 extending from the bottom part B1 to the gas pipe GP in an obliquely upwardly tilting posture. The third part R3 thus extends from the bottom part B1 in an obliquely upwardly tilting posture. Hence, the refrigerant flown into the third part R3 through the coupling portion J1 when the refrigerant has been bypassed from the second part R2 to the first part R1, the refrigerant is likely to drop toward the coupling portion J1 without being accumulated within the third part R3.

(6-5)

In the aforementioned embodiment, the plural BS units 70 are disposed within the casing 131 of the intermediate unit 130. In other words, the intermediate unit 130 is good in compactness and aggregates, within the casing 131, the plural BS units 70 that inhibit degradation in performance of the air conditioning system 100. Thus, it is possible to compactly construct the intermediate unit 130 that inhibit degradation in performance of the air conditioning system 100.

(7) Modifications (7-1) Modification A

In the aforementioned embodiment, the air conditioning system 100 is designed to include a single set of the outdoor unit 110. However, the number of sets of the outdoor units 110 is not limited to the above, and may be plural. Additionally, the air conditioning system 100 is designed to include 16 sets of the indoor units 120. However, the number of sets of the indoor units 120 is not limited to the above, and may be any arbitrary number.

(7-2) Modification B

In the aforementioned embodiment, the intermediate unit 130 (the BS unit assembly 60) is designed to include 16 sets of the BS units 70. However, the number of sets of the BS units 70 is not limited to the above, and may be any arbitrary number. For example, the number of sets of the BS units 70 disposed in the intermediate unit 130 (the BS unit assembly 60) may be four, six or eight, and alternatively, may be twenty-four.

(7-3) Modification C

In the aforementioned embodiment, in the intermediate unit 130 (the BS unit assembly 60), the first units 71 and the second units 72 (the liquid communicating units 73) are alternately aligned in the horizontal direction. However, alignment of the first units 71 and the second units 72 is not limited to the above. For example, the first units 71 and the second units 72 (the liquid communicating units 73) may be alternately disposed in vertical alignment.

(7-4) Modification D

In the aforementioned embodiment, the BS units 70 are accommodated in the casing 131 in the state of being aggregated as the BS unit assembly 60. However, the construction to accommodate the BS units 70 in the casing 131 is not limited to the above. Each of the BS units 70 may be accommodated in a separate casing without being aggregated with the other BS units 70 as the BS unit assembly 60. In this case, the first header 55, the second header 56 or the third header 57 may not be provided, and the first part R1 (the sixth pipe P6), the second part R2 (the eighth pipe P8) or the liquid communicating unit 73 (the first pipe P1) may be designed to be directly connected to the high-low pressure gas communicating pipe 13, the suction gas communicating pipe 12 or the liquid communicating pipe 11.

(7-5) Modification E

In the aforementioned embodiment, electric valves are employed as the first electric valve Ev1, the second electric valve Ev2 and the third electric valve Ev3. However, the first electric valve Ev1, the second electric valve Ev2 or the third electric valve Ev3 may be necessarily an electric valve, and may be alternatively, for instance, an electro-magnetic valve.

(7-6) Modification F

In the aforementioned embodiment, in a plan view, the first electric valve Ev1 and the second electric valve Ev2 are located on a straight line on which the bottom part B1 of the fourth pipe P4 and the fifth pipe P5 extend (see FIG. 7, etc.). However, positional arrangement of the first electric valve Ev1 and the second electric valve Ev2 is not limited to the above. Alternatively, the first electric valve Ev1 and the second electric valve Ev2 may be arbitrarily arranged as long as they are located on a straight line on which either the bottom part B1 of the fourth pipe P4 or the fifth pipe P5 extends in a plan view.

(7-7) Modification G

In the aforementioned embodiment, the electric valve employed as the second electric valve Ev2 is of a type that the minute channel is formed in its interior and that is configured not to be fully closed even at the minimum opening degree. However, the electric valve employed as the second electric valve Ev2 is not limited to be of this type. Alternatively, the electric valve employed as the second electric valve Ev2 may be of a type that any minute channel is not formed in its interior, and a bypass pipe such as a capillary tube may be connected to the second electric valve Ev2.

INDUSTRIAL APPLICABILITY

The present invention can be utilized for a refrigerant channel switching unit and an aggregated channel switching unit.

What is claimed is:

1. A refrigerant channel switching unit adapted to be disposed between a heat source unit and a utilization unit, the refrigerant channel switching unit being configured and arranged to switch flow of refrigerant in a refrigerant circuit formed by the heat source unit and the utilization unit, the refrigerant channel switching unit comprising:

a first refrigerant pipe connected to a suction gas communicating pipe extending from the heat source unit;

a second refrigerant pipe connected to a high-low pressure gas communicating pipe extending from the heat source unit;

a third refrigerant pipe connected to a gas pipe extending to the utilization unit;

a coupling portion connected to the first refrigerant pipe, the second refrigerant pipe and the third refrigerant pipe, the coupling portion being configured and arranged to couple the first refrigerant pipe, the second refrigerant pipe and the third refrigerant pipe therethrough;

a first switch valve mounted to the first refrigerant pipe; and a second switch valve mounted to the second refrigerant pipe, the second switch valve being disposed in a higher position than the first switch valve, and the third refrigerant pipe including a bottom part in a lowest height position of the third refrigerant pipe and a tilt part configured and arranged to extend from the bottom part toward the gas pipe side in an obliquely upwardly tilting posture, and the third refrigerant pipe being connected to the coupling portion at the bottom part.

2. A refrigerant channel switching unit adapted to be disposed between a heat source unit and a utilization unit, the refrigerant channel switching unit being configured and arranged to switch flow of refrigerant in a refrigerant circuit formed by the heat source unit and the utilization unit, the refrigerant channel switching unit comprising:

a first refrigerant pipe connected to a suction gas communicating pipe extending from the heat source unit;

a second refrigerant pipe connected to a high-low pressure gas communicating pipe extending from the heat source unit;

a third refrigerant pipe connected to a gas pipe extending to the utilization unit;

a coupling portion connected to the first refrigerant pipe, the second refrigerant pipe and the third refrigerant pipe, the coupling portion being configured and arranged to couple the first refrigerant pipe, the second refrigerant pipe and the third refrigerant pipe therethrough;

a first switch valve mounted to the first refrigerant pipe; and a second switch valve mounted to the second refrigerant pipe, the first refrigerant pipe including a horizontally extending part configured and arranged to extend along a horizontal direction, the second refrigerant pipe including a vertically extending part configured and arranged to extend along a vertical direction, the third refrigerant pipe including a bottom part in a lowest height position of the third refrigerant pipe, the bottom part being configured and arranged to extend along an extending direction of the horizontally extending part, and the coupling portion being a pipe coupler having an inverted T shape, the coupling portion being connected to the horizontally extending part, the vertically extending part and the bottom part.

3. The refrigerant channel switching unit according to claim 2, wherein in a plan view, the first switch valve and the second switch valve are located on a straight line on which the horizontally extending part or the bottom part extends.

4. A refrigerant channel switching unit adapted to be disposed between a heat source unit and a utilization unit, the refrigerant channel switching unit being configured and arranged to switch a flow of refrigerant in a refrigerant circuit formed by the heat source unit and the utilization unit, the refrigerant channel switching unit comprising:

a first refrigerant pipe connected to a suction gas communicating pipe extending from the heat source unit;

a second refrigerant pipe connected to a high-low pressure gas communicating pipe extending from the heat source unit;

a third refrigerant pipe connected to a gas pipe extending to the utilization unit;

a coupling portion connected to the first refrigerant pipe, the second refrigerant pipe and the third refrigerant pipe, the coupling portion being configured and arranged to couple the first refrigerant pipe, the second refrigerant pipe and the third refrigerant pipe therethrough;

a first switch valve mounted to the first refrigerant pipe; and a second switch valve mounted to the second refrigerant pipe, the second switch valve being disposed in a higher position than the first switch valve, the third refrigerant pipe including a bottom part in a lowest height position of the third refrigerant pipe, the third refrigerant pipe being connected to the coupling portion at the bottom part, the first refrigerant pipe including a horizontally extending part configured and arranged to extend along a horizontal direction, the bottom part extending along an extending direction of the horizontally extending part, and the coupling portion being a pipe coupler having an inverted T shape, the coupling portion being connected to the horizontally extending part and the bottom part.

5. The refrigerant channel switching unit according to claim 4, wherein in a plan view, the first switch valve and the second switch valve are located on a straight line on which the horizontally extending part or the bottom part extends.

* * * * *